US010760866B2

(12) United States Patent
Facchini et al.

(10) Patent No.: US 10,760,866 B2
(45) Date of Patent: Sep. 1, 2020

(54) FIREARM SOUND SUPPRESSOR

(71) Applicant: FIMS Manufacturing Corp., Oakland, NJ (US)

(72) Inventors: Michael Facchini, Oakland, NJ (US); Matthew Steinhauser, Oakland, NJ (US)

(73) Assignee: FIMS Manufacturing Corp., Oakland, NJ (US)

( * ) Notice: Subject to any disclaimer, the term of this patent is extended or adjusted under 35 U.S.C. 154(b) by 77 days.

(21) Appl. No.: 16/193,868

(22) Filed: Nov. 16, 2018

(65) Prior Publication Data

US 2020/0025490 A1 Jan. 23, 2020

Related U.S. Application Data

(60) Provisional application No. 62/587,865, filed on Nov. 17, 2017.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34
USPC ..... 89/14.4
See application file for complete search history.

(56) References Cited

U.S. PATENT DOCUMENTS

| | | | | |
|---|---|---|---|---|
| 1,017,003 | A * | 2/1912 | Kenney | F41A 21/30 181/223 |
| 3,667,570 | A * | 6/1972 | WerBell, III | F41A 21/30 181/223 |
| 5,029,512 | A * | 7/1991 | Latka | F41A 21/30 181/223 |
| 5,136,923 | A | 8/1992 | Walsh, Jr. | |
| 8,167,084 | B1 * | 5/2012 | Moore | F41A 21/30 181/223 |
| 8,950,310 | B2 * | 2/2015 | Storrs | F41A 21/30 181/223 |
| 9,347,727 | B1 * | 5/2016 | Cler | F41A 21/30 |
| 9,599,421 | B1 | 3/2017 | Dean | |
| 9,658,018 | B1 | 5/2017 | Heckert et al. | |
| 9,677,839 | B1 | 6/2017 | Phoenix | |

(Continued)

*Primary Examiner* — Joshua E Freeman
(74) *Attorney, Agent, or Firm* — John H. Choi & Associates

(57) ABSTRACT

A sound suppressor for a firearm includes an enclosure enclosing at least a portion of a barrel of the firearm. An intermediate member is coupled to an outer end of the barrel and includes a base member, ring member and a plurality of extension members therebetween. The base member is positioned proximate the intermediate member inner end and includes a through-hole extending longitudinally therethrough. The ring member is positioned proximate the intermediate member outer end. A space between the plurality of extension members forms a chamber. The sound suppressor also includes a flash hider coupled to the intermediate member outer end. The flash hider includes a plurality of baffles extending radially and spaced apart longitudinally from the flash hider inner end to the flash hider outer end, and a plurality of open channels formed between the plurality of baffles. The intermediate member and flash hider are enclosed within the enclosure.

19 Claims, 26 Drawing Sheets

(56) References Cited

U.S. PATENT DOCUMENTS

| | | | | |
|---|---|---|---|---|
| 9,683,801 | B2 * | 6/2017 | Myers | F41A 21/30 |
| 9,719,745 | B2 * | 8/2017 | Palu | F41A 21/30 |
| 9,933,224 | B2 * | 4/2018 | Dorne | F41A 21/28 |
| 2010/0163336 | A1 * | 7/2010 | Presz, Jr. | F41A 13/08<br>181/223 |
| 2010/0180759 | A1 * | 7/2010 | Petersen | F41A 21/30<br>89/14.4 |
| 2012/0180624 | A1 * | 7/2012 | Troy | F41A 21/30<br>89/14.4 |
| 2013/0312592 | A1 * | 11/2013 | Storrs | F01N 3/02<br>89/14.1 |
| 2017/0115084 | A1 * | 4/2017 | Hailey | F41A 21/30 |
| 2017/0191779 | A1 * | 7/2017 | Myers | F41A 21/48 |
| 2017/0299313 | A1 * | 10/2017 | Adamson, Jr. | F41A 21/30 |
| 2018/0195825 | A1 * | 7/2018 | Schoenfeld | F41A 21/30 |
| 2018/0202744 | A1 * | 7/2018 | De Sousa | F41A 21/30 |
| 2018/0209757 | A1 * | 7/2018 | Hibbitts | F41A 21/30 |
| 2018/0340750 | A1 * | 11/2018 | Mooty | F41A 21/30 |

* cited by examiner

FIREARM SOUND SUPPRESSOR

CROSS-REFERENCE TO RELATED APPLICATIONS

This application claims priority to U.S. Provisional Application No. 62/587,865, filed on Nov. 17, 2017, which is incorporated by reference in its entirety.

FIELD

The present disclosure relates generally to systems and methods for suppressing noise, and more particularly, to systems and methods for suppressing noise of a firearm.

BACKGROUND

Suppressors for firearms, also known as silencers, generally operate to reduce the audible noise or sharp report of a firing weapon by means of reducing and controlling the energy level of attendant propellant gases. A firearm sound suppressor typically mounts to the end of the muzzle of a firearm and is usually a hollow metal cylinder which has expansion chambers therein and which attaches to the muzzle of a firearm. This type of sound suppressor is readily attached to the end of a firearm barrel and may be used on different firearms of the same caliber.

Firearm sound suppressors work by trapping and delaying the exit of the high pressure muzzle gases from a firearm when the firearm is discharged. Creation of turbulence is one technique used to enhance the trapping of the gases with a subsequent delay in the exit of the gases from a sound suppressor. If a sound suppressor is very effective at trapping and delaying the exit of the gases, this results in a lower sound level coming from the firearm.

Known silencers for firearms can be generally classified into two groups. In one group, the discharge and propellant gases that follow the bullet into the silencer are stored for a short period of time in a plurality of successive chambers which are closed to the outside environment. This produces a controlled expansion of the propellant gases through each chamber, thereby reducing their temperature and pressure.

In a second group, at least a portion of the propellant gases are diverted to exterior coaxial chambers through a plurality of passages between inner and outer walls. Although such arrangements can be complex, these arrangements can provide more capacity to delay and cool the gases, and hence reduce the sound level.

Generally, the techniques include the provision of a series of baffles which control and delay the flow, expansion, and discharge of propellant gases, forcing the propellant gases to pass through various temperature absorbent materials to reduce the temperature and abrupt discharge of propellant gases. The result achieved is a corresponding reduction in the noise produced by the discharged propellant gases.

A firearm suppressor suppresses noise by allowing the rapidly expanding gases from the firing of a cartridge to be diverted or trapped inside a series of chambers. The trapped gas expands and cools, reducing its pressure and velocity before it exits the suppressor. The suppressor chamber may be a single large expansion chamber located at the muzzle end of a firearm to allow the propellant gas to expand considerably and slow before it encounters the baffles therein. Baffles used in sound suppressors are usually circular metal dividers which separate the expansion chamber with each baffle having a hole therethrough to permit passage of gas through the baffle. The aperture in each baffle and the passageway through the sound suppressor are generally slightly larger than the bullet caliber to reduce the risk of a bullet hitting the sides of the housing in the sound suppressor. A sound suppressor housing can become heated to a very high temperature because of the collection of rapidly expanding gases from firing of multiple cartridges, especially in rapid fire weapons.

For typical suppressors, it may become difficult to remove the suppressor from the suppressor housing for cleaning. Tough residue from the discharge gases can build up quickly in and around crevices, creating a bond between the suppressor components which can be difficult to break. Moreover, baffles closer to the muzzle end of the firearm are subjected to greater pressure, contaminants, and heat from the firearm flash during discharge, than baffles located further away from the muzzle end, thereby causing premature wear and failure of the suppressor.

Another disadvantage of current firearm suppressor use is the problem of suppressor instability that results from the use of a threaded connection of the suppressor to the barrel of a firearm. The barrel of a firearm that is designed for attachment of a suppressor is typically provided with a reduced diameter externally threaded section that is of fairly short length. An internally threaded section of a typical suppressor is fairly short, thus causing the threaded connection to have minimal stability due to the typical length of the threaded connection of the suppressor with the firearm barrel.

U.S. Pat. No. 5,136,923 discloses a firearm silencer which includes an outer housing and an interior tube (a central channel) within the housing. The interior tube is spaced from the inside walls of the housing to form an exterior chamber around the interior tube. The interior tube is adapted to receive a projectile discharged from a firearm and extends the entire length of the housing which is attached to a muzzle of a firearm. The interior tube is perforated with a plurality of rows of ports which extend through the wall of the interior tube and discharge into the exterior chamber. The sound suppressing performance of this type of suppressor is considered to be due to the rapid heat exchange between the propellant gases and the surface area of the conductive metal in the suppressor. The efficiency of this type silencer is considered greater on a volume basis for a given projectile clearance than that of baffle silencers. However, because of the limited surface area inherent in this type of design, this type of suppressor is useful only for small fire arms. A sound suppressor of this design having substantially increased surface area for a given volume, for heat dissipation, and that could create greater turbulance of the gases around the length of the interior tube, would be much more effective in suppressing sound and attenuating recoil.

Another problem with prior art suppressors is the large size, especially for suppressors used on rifles which add much overall length to the firearm. Because suppressors for rifles are often long, the length of the rifle is drastically increased, making it inconvenient during use and for storage. For gas impingement rifles and rifles with piston operating systems, such increased length is unavoidable due to the gas tube being positioned directly above the barrel. As such, prior art suppressors are installed on the barrel past the gas block.

It is desirable to provide a suppressor which is conveniently and efficiently assembled to and disassembled from the firearm for convenient cleaning and maintenance. Additionally, it is desirable to provide a suppressor that is exceptionally stable as well as protecting the internal components from the undesirable characteristics of gunpowder residue buildup and fouling. Moreover, it is desirable to provide a suppressor that further suppresses noise and flash discharge, while not unduly increasing the overall length of the firearm. Finally, it is desirable to provide a suppressor that could be integrated with the gas block and gas tube of the firearm.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention solves the problems of the prior art described above and provides additional advantages. To do so, the present invention provides a suppressor comprising a tube that extends along the entire length of a barrel thus reducing the increased overall length of the fire arm. A tube encloses the barrel and gas tube, and is sealed with rear and front end caps. Within the tube is a main body where a gas block is enclosed; an intermediate member operably coupled to the barrel end; a blast baffle operably coupled to the intermediate member; and a flash hider operably coupled to the intermediate member and blast baffle.

The present invention provides a sound suppressor for a firearm comprising: an enclosure enclosing at least a portion of a barrel of the firearm, the barrel having an inner end and an outer end and extending longitudinally from a receiver of the firearm with the barrel inner end operably coupled to the receiver of the firearm, a space between the enclosure and barrel forming a main body; an intermediate member having an inner end and an outer end, the intermediate member inner end operably coupled to an outer end of the barrel, the intermediate member comprising: a base member positioned proximate the intermediate member inner end, the base member having a first through-hole extending longitudinally therethough, a ring member having an inner surface and an opposing outer surface, the ring member positioned proximate the intermediate member outer end, and a plurality of extension members, each extension member having an inner and an opposing outer end, and an inner surface and an opposing outer surface, the plurality of extension members extending between the base member and the ring member, a space between the plurality of extension members forming a chamber; a flash hider having an inner end and an outer end, the flash hider inner end operably coupled to the intermediate member outer end, the flash hider comprising: a plurality of baffles extending radially and spaced apart longitudinally from the flash hider inner end to the flash hider outer end, and a plurality of open channels formed between the plurality of baffles, each open channel having a longitudinal width; wherein the intermediate member and flash hider are enclosed within the enclosure.

In another aspect, the present invention provides a sound suppressor for a firearm comprising: an enclosure enclosing at least a portion of a barrel of the firearm, the barrel having an inner end and an outer end and extending longitudinally from a receiver of the firearm with the barrel inner end operably coupled to the receiver of the firearm; an intermediate member having an inner end and an outer end, the intermediate member inner end operably coupled to an outer end of the barrel; and a flash hider having an inner end and an outer end, the flash hider inner end operably coupled to the intermediate member outer end; wherein the intermediate member and flash hider are enclosed within the enclosure.

In yet another aspect, the present invention provides a method for suppressing noise in a firearm by providing a sound suppressor having an enclosure enclosing at least a portion of a barrel of the firearm, the barrel having an inner end and an outer end and extending longitudinally from a receiver of the firearm with the barrel inner end operably coupled to the receiver of the firearm; an intermediate member having an inner end and an outer end, the intermediate member inner end operably coupled to an outer end of the barrel, a space within the intermediate member forming a chamber; and a flash hider having an inner end and an outer end, the flash hider inner end operably coupled to the intermediate member outer end, the flash hider having a plurality of baffles extending radially and spaced apart longitudinally from the flash hider inner end to the flash hider outer end such that a plurality of open channels are formed between the plurality of baffles; wherein the intermediate member and flash hider are enclosed within the enclosure. The sound suppressor causes gases formed from a traveling projectile to be displaced within the chamber of the intermediate member substantially in a direction from the intermediate member outer end to the intermediate member inner end. The sound suppressor also causing gases formed from the traveling projectile to be displaced within the flash hider substantially in a direction from the flash hider outer end to the flash hider inner end.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In addition, some of the figures are provided further details including exemplary dimensions which are in units of inches.

In the drawings.

Figure 1:
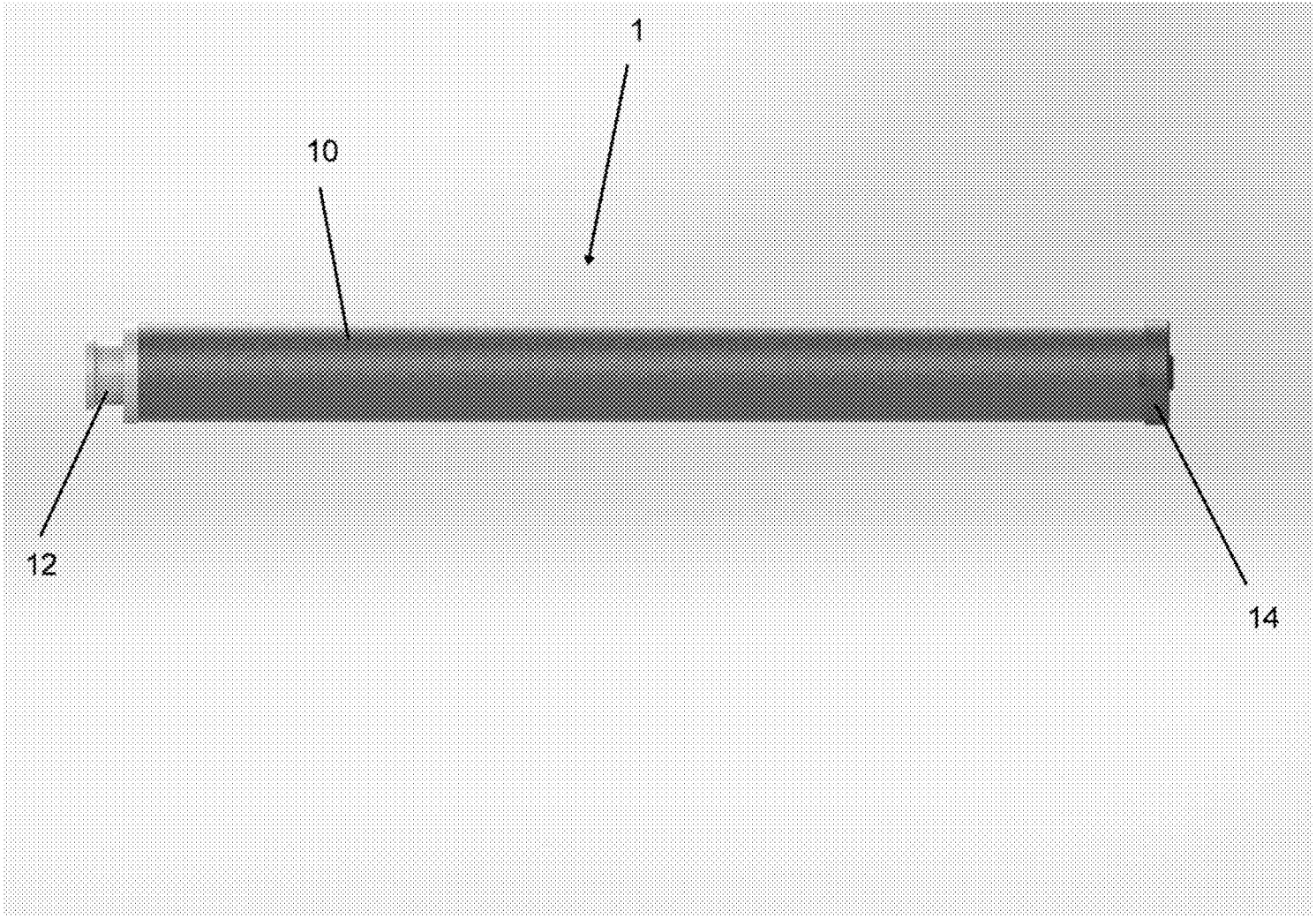
FIG. 1 is a side view of an embodiment of a suppressor of the present invention.
Figure 2:
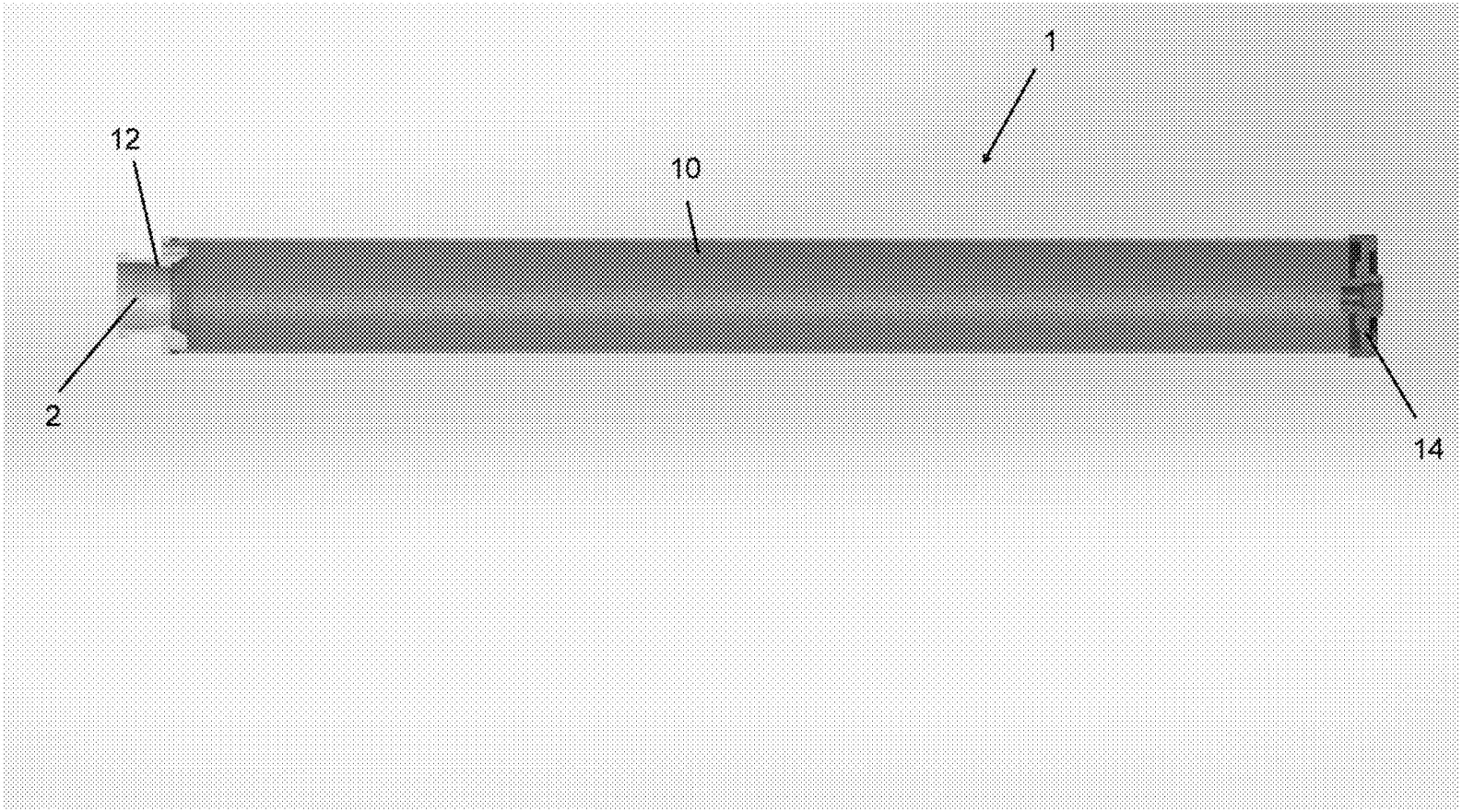
FIG. 2 is a side cross-sectional view of the suppressor of FIG. 1, shown without internal components.
Figure 3:
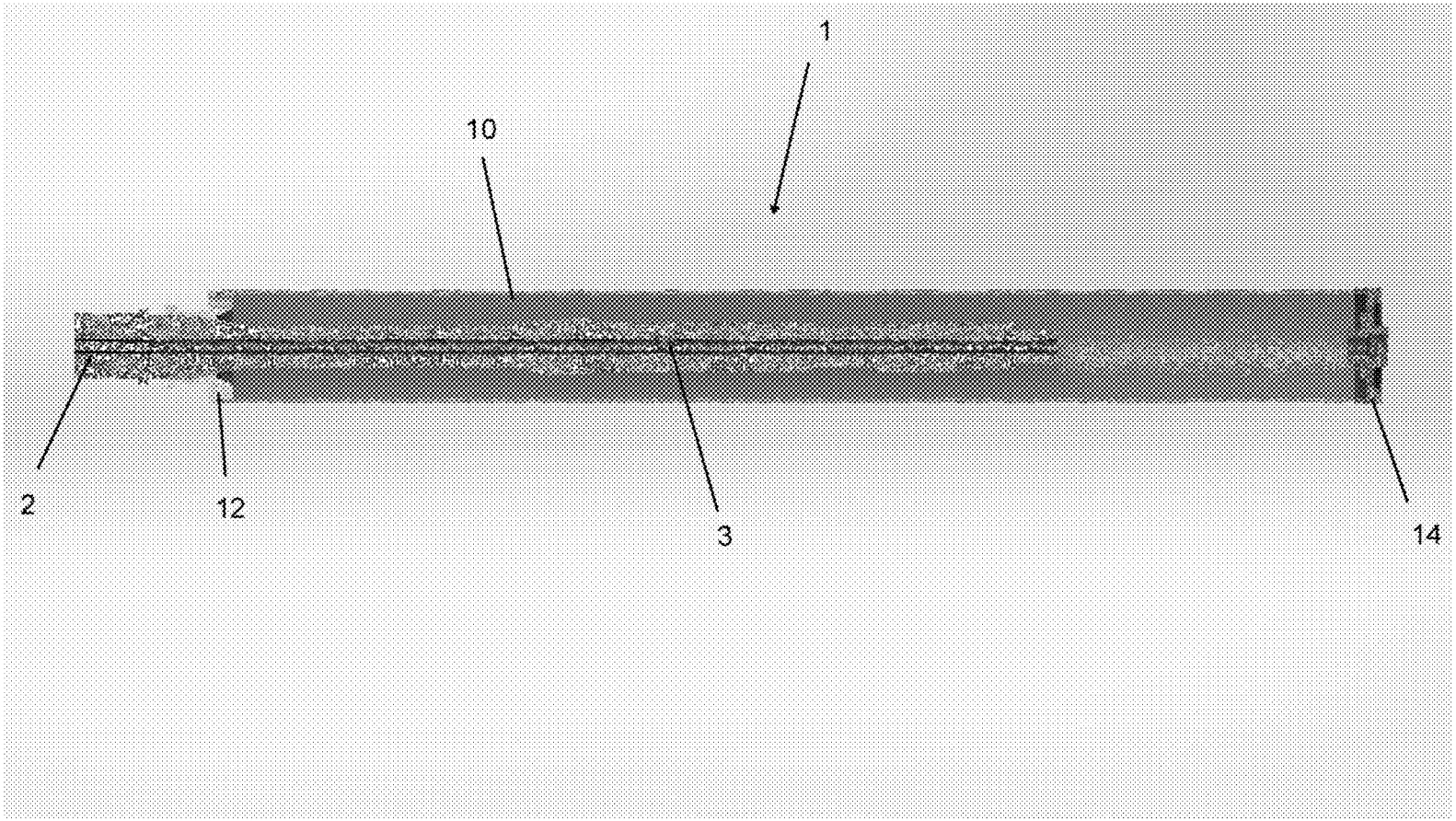
FIG. 3 is another side cross-sectional view of the suppressor of FIG. 1 attached to a barrel of a firearm, shown without internal components.

To facilitate an understanding of the invention, identical reference numerals have been used, when appropriate, to designate the same or similar elements that are common to the figures. Further, unless stated otherwise, the features shown in the figures are not drawn to scale but are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left are used to describe the accompanying figures. The terminology includes the words above specifically mentioned, derivatives thereof, and words of similar import.

Figure 4:
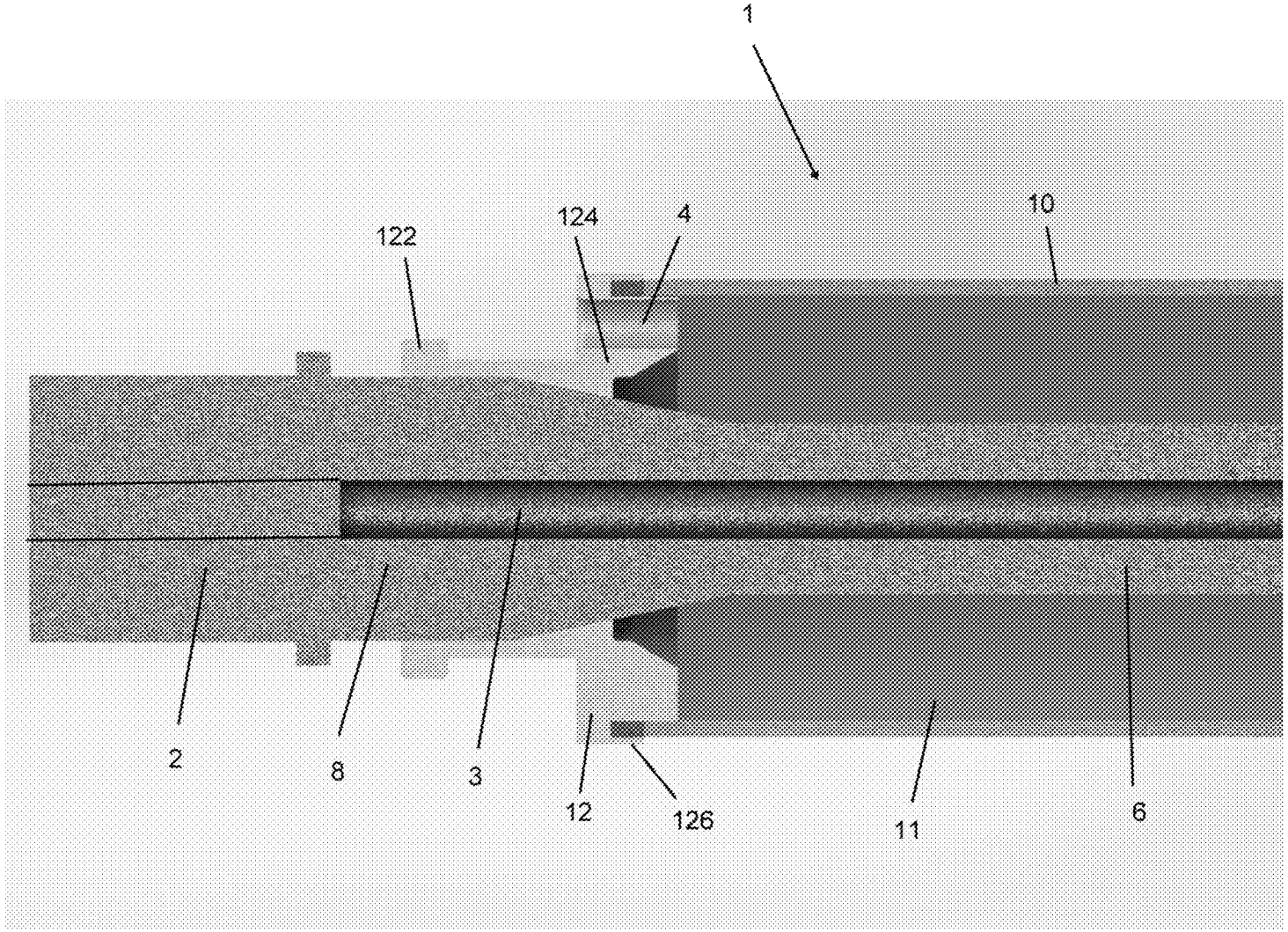
FIG. 4 is a side cross-sectional view of the barrel and suppressor of FIG. 3.

Referring to FIGS. 1-4, an exemplary embodiment of a suppressor 1 of the present invention is shown. In general, the suppressor 1 is configured to enclose a barrel 2 of a firearm. In this embodiment, the barrel 2 is of a rifle having a gas impingement system and the suppressor 1 encloses both the barrel 2 and gas tube or gas piston 4 of the firearm, as shown in FIG. 4. Even though the present embodiment shows a suppressor for use on this type of firearm, it can also be used on other types of firearms as well. The suppressor 1 generally comprises a tube 10 enclosed by a rear end cap 12 on one end and a front end cap 14 on an opposing end of the tube 10. The tube 10 is substantially cylindrical and is constructed of a high-strength material such as stainless steel, 4140 high tensile steel, B7 alloy steel and titanium. One of ordinary skill in the art will recognize that other materials could be used as well. Optionally, a hand guard could be installed on the suppressor 1, fully or partially enclosing the same.

Figure 5:
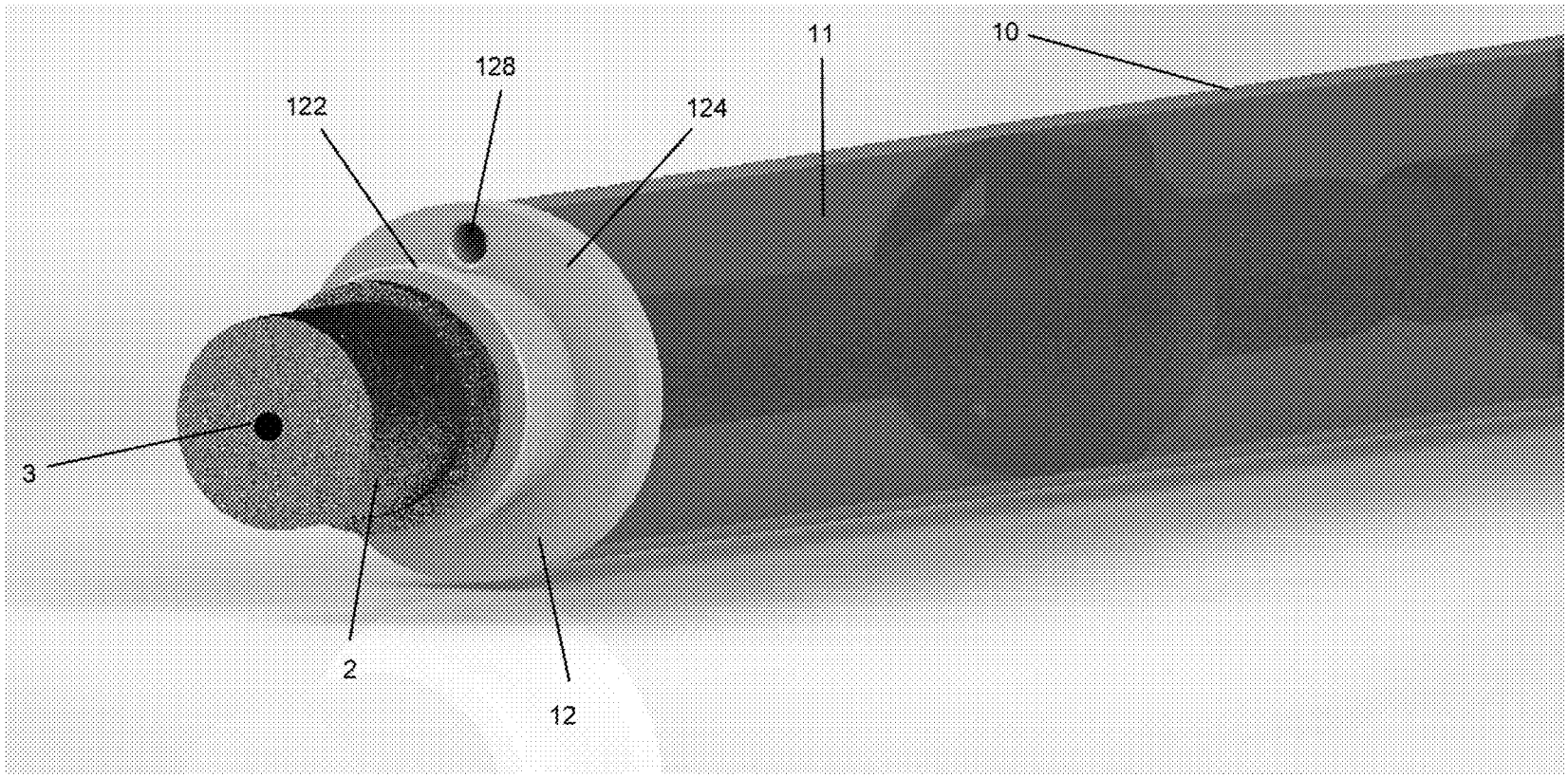
FIG. 5 is a rear perspective view of the suppressor of FIG. 3 showing a gas block superimposed within a tube.

Referring to FIGS. 4 and 5, the rear end cap 12 is fixed to the tube 10 and is sealed against the barrel 2 and positioned rearward from a barrel extension portion 6 of the barrel 2 and on a base portion 8 of the barrel 2. Although not fully shown in FIGS. 4 and 5, a bore 3 extends completely through the barrel 2. The rear end cap 12 includes an inner section 122 having an inner diameter substantially equal to the barrel base 8 and an outer section 124 having an outer diameter slightly greater than the diameter of the tube 10. The outer section 124 includes a lip portion 126 that surrounds an inner end of the tube 10. Thus, the rear end cap 12 is form fit onto the barrel 2 as well as the tube 10. The lip portion 126 provides a secure seal and prevents gas from exiting the tube 10 and also protects the rear end cap 12 from damage, as damage in this area would result in gas leakage and cause the suppressor 1 to malfunction. The rear end cap 12 includes an aperture 128 that is sized substantially the same and aligned with the gas tube 4 so that the gas tube 4 extends therethrough, as shown in FIG. 5, while still providing a seal. As such, the gas tube is integrated into the rear end cap 12 or the piston passes through the rear end cap 12 and into the upper receiver. Thus, the rear end cap 12 is capable of being machined onto the barrel 2.

Figure 6:
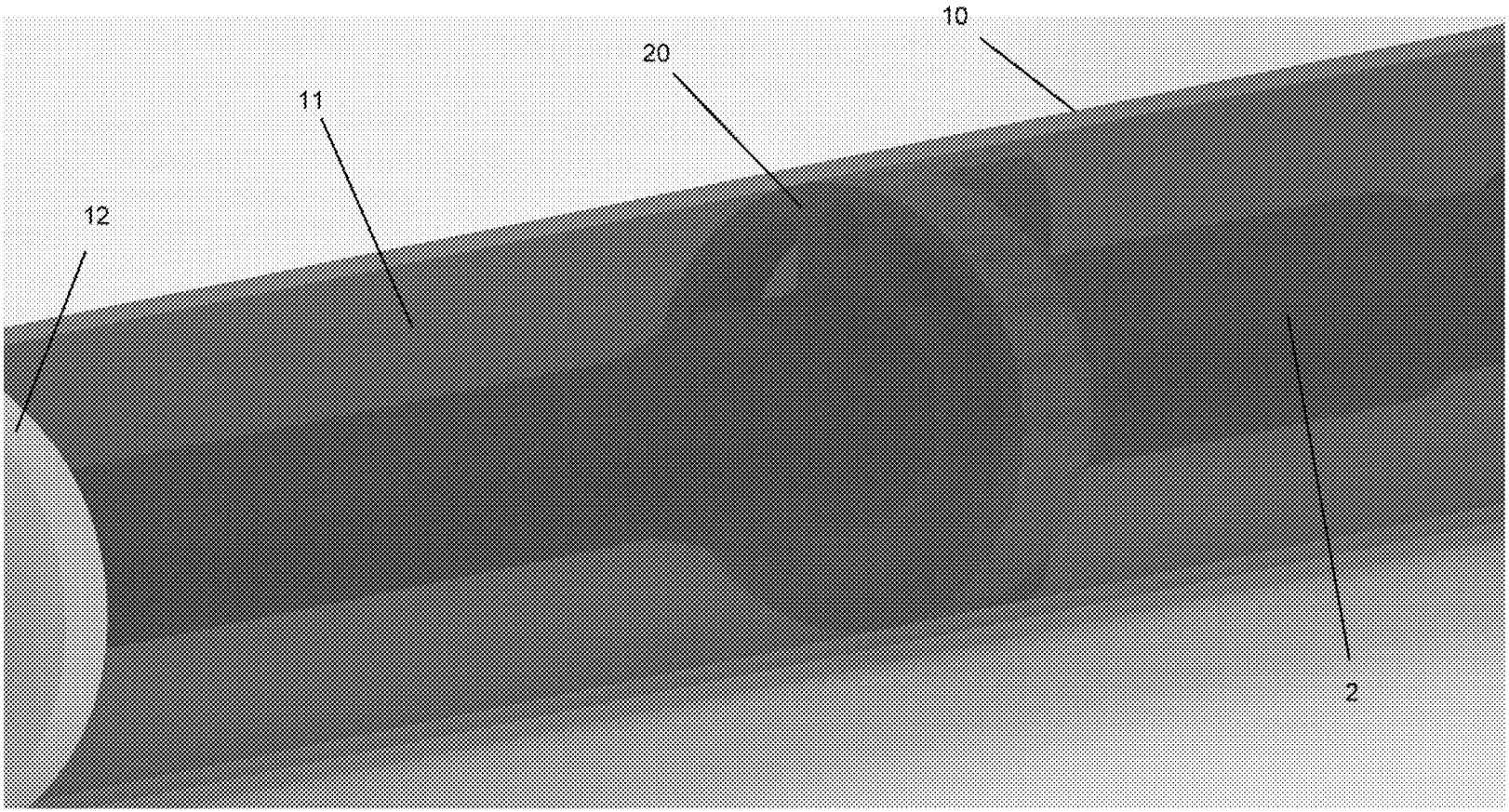
FIG. 6 is a close-up view of FIG. 5.
Figure 7:
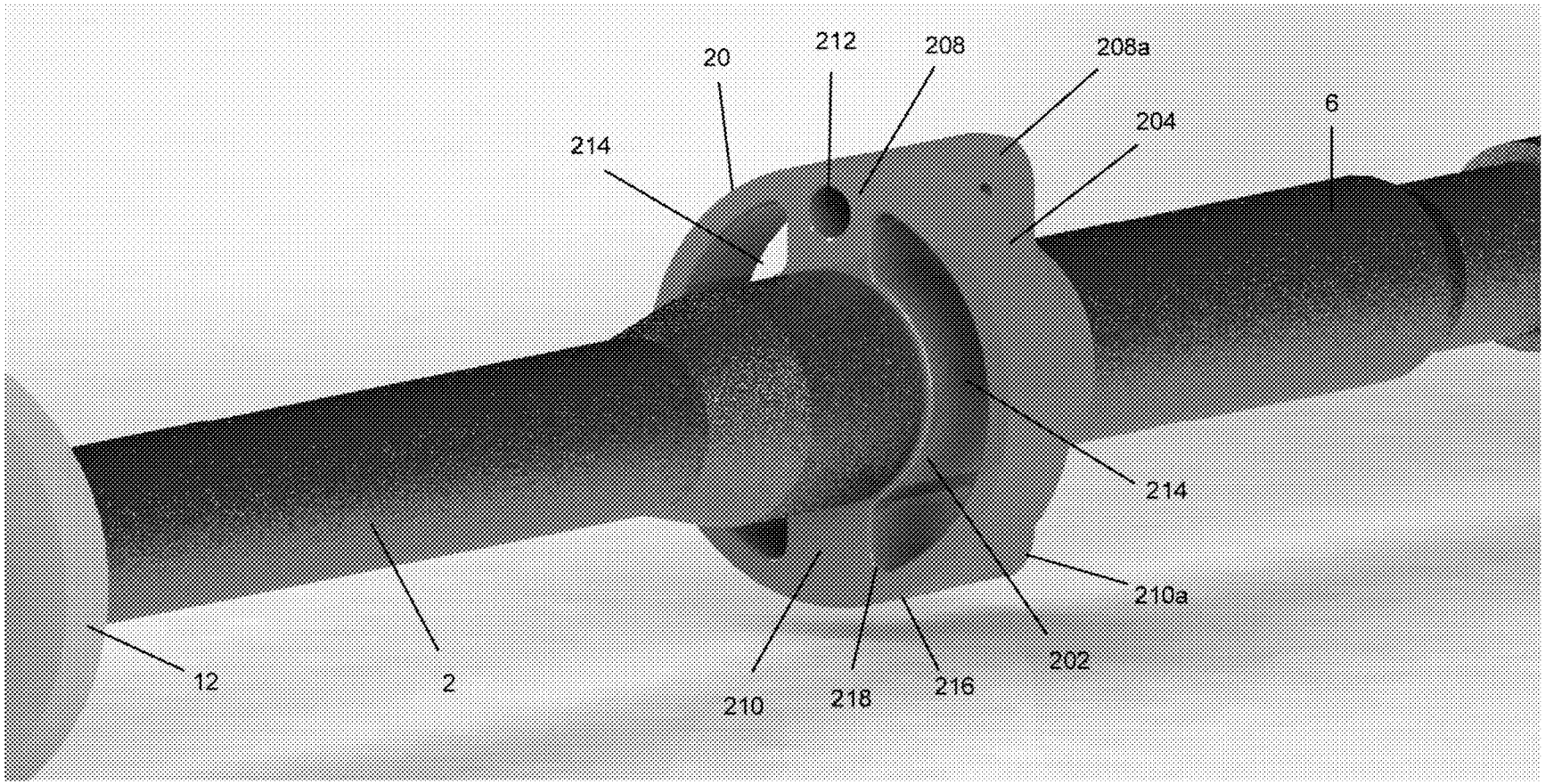
FIG. 7 is a rear perspective view of the gas block and barrel of the previous figures.
Figure 8:
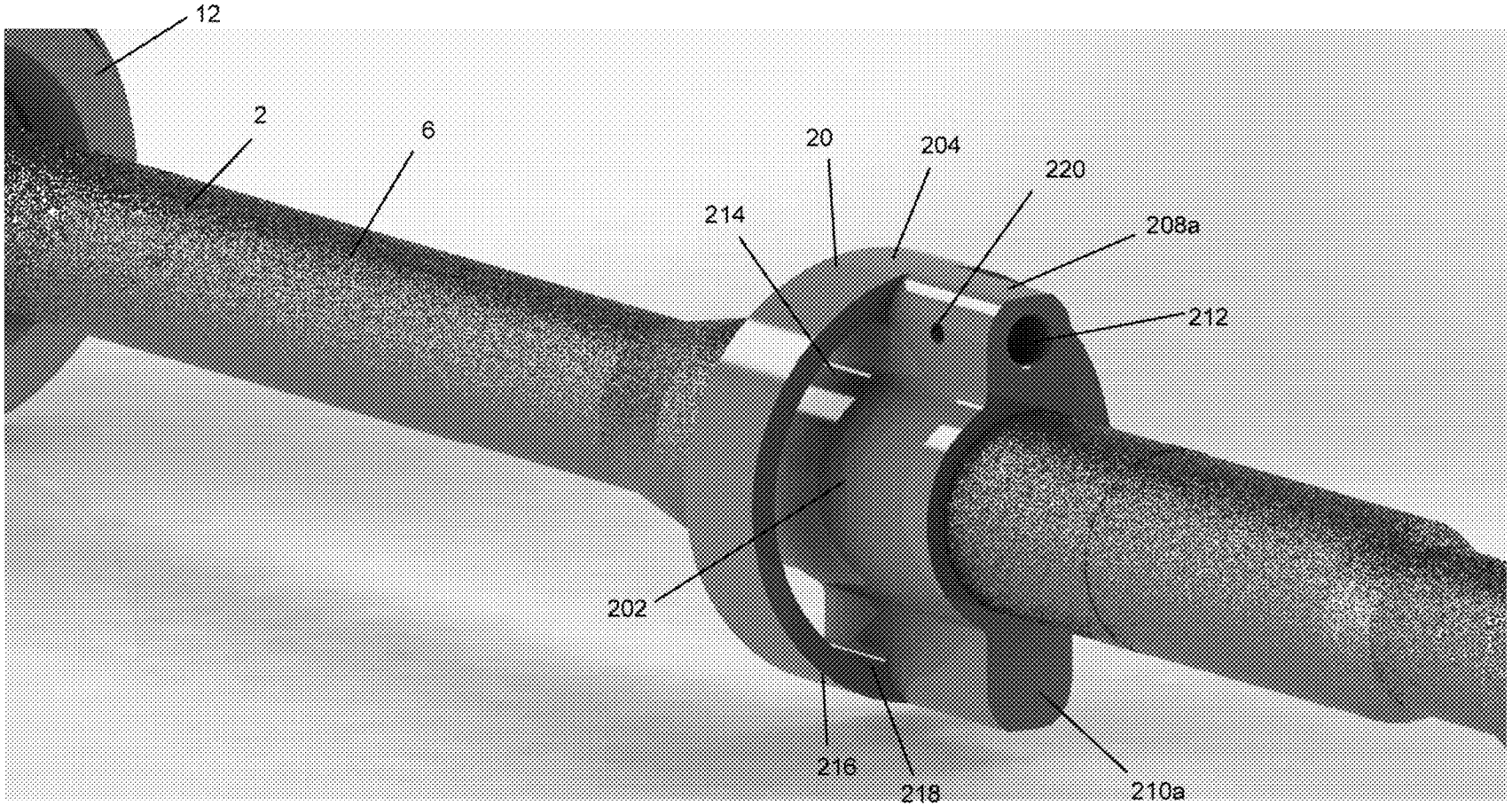
FIG. 8 is a front perspective view of the gas block and barrel of FIG. 7.

Referring to FIGS. 6-8, a gas block 20 is positioned on the barrel extension 6 and enclosed by the tube 10 within a main body 11. The gas block 20 includes an inner section 202 and an outer section 204 integrally formed with each other. The inner section 202 is substantially cylindrical and sized to be positioned on the barrel extension 6 in a secure form fit. The inner section 202 includes an opening or aperture (not shown) which coincides with and is aligned with another opening or aperture (not shown) on the barrel extension 6. The inner section 202 could include more than one opening or aperture depending on the number of openings or apertures on the barrel extension 6. The outer section 204 is also substantially cylindrical and is connected integral to the inner section 202 by upper and lower rib members 208, 210. The outer section 204 is shaped and sized substantially similar to an inner surface of the tube 10 to form a support structure for the main body 11 to make the tube 10 less susceptible to damage such as dings and dents. The upper rib member 208 includes an inner aperture (not shown) which is connected with the aperture of the inner section 202 and aperture of the barrel extension 6. The upper rib member 208 also includes an outer aperture 212 which is configured to be coupled with the gas tube 4. The outer aperture 212 is connected with the aperture of inner section 202 and the aperture of the barrel extension 6 to form an unimpeded path for gas to travel from the inner barrel 2 to the gas tube 4 and to an upper receiver of the firearm.

As shown in FIG. 8, the rib members 208, 210 of the gas block 20 extend toward the front of the barrel 2 forming rib extensions 208*a*, 210*a*. The rib extensions 208*a*, 210*a* engage the inner surface of the tube 10 to provide additional support to the main body 11. The outer aperture 212 extends through the upper rib extension 208*a*, which also includes a side aperture 220 connected to the outer aperture 212. In this configuration, excess gas can be displaced from the gas tube 4 through the side aperture 220, for example during emergency situations when the excess gas is formed in the gas tube 4 and upper receiver. Alternatively, the side aperture 220 is used for indexing the gas tube, for example, with a spring pin, so that the gas tube 4 is properly positioned within the aperture 212. The gas block 20 is configured to accommodate standard gas tubes used in the industry. However, modifications could be made to accommodate other types of gas tubes.

A plurality of open channels 214 are formed between the inner and outer sections 202, 204. In this embodiment, two open channels 214 are provided so that gas can travel within the main body 11 of the tube 10. In the alternative, the open channels 214 could be eliminated and comprise of a solid material to form a shorter suppressor. Referring to FIGS. 7 and 8, outside edges 216 of the outer section 204 are sharp to aid in cleaning carbon exhaust and build up from the inner surface of the tube 10. That is, when the tube 10 is removed from the barrel 2, the sharp edges 216 will naturally scrape residue off of the inner surface of the tube 10 with little resistance. Inner edges 218 of the outer section 204, being a high-stress area, are chamfered or radiused to prevent distortion of the outer section 204 and for relieving stress. As described above, the gas block 20 is capable of being machined onto the barrel 2.

Referring to FIGS. 9-15, an intermediate member 30 is shown attached to the front end of the barrel extension 6. The intermediate member 30 is shaped and sized to fit snugly within the tube 10 to provide additional support for the tube 10. Generally, the intermediate member 30 includes a base member 32 and an opposing ring member 36 with extension members 34 positioned therebetween, the components of which are integrally formed together.

Figure 11:
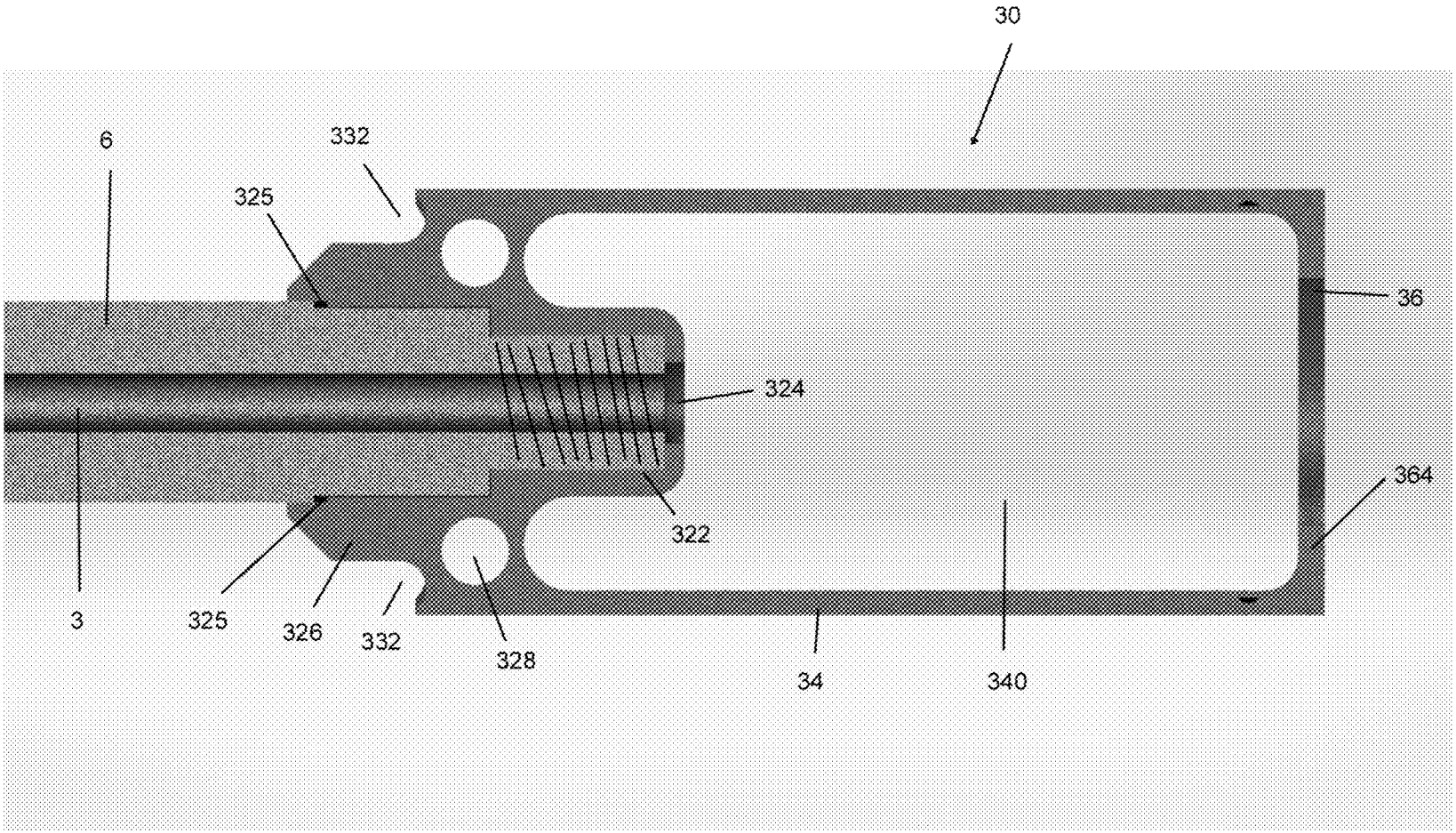
FIG. 11 is a cross-sectional view of the barrel and intermediate member.
Figure 12:
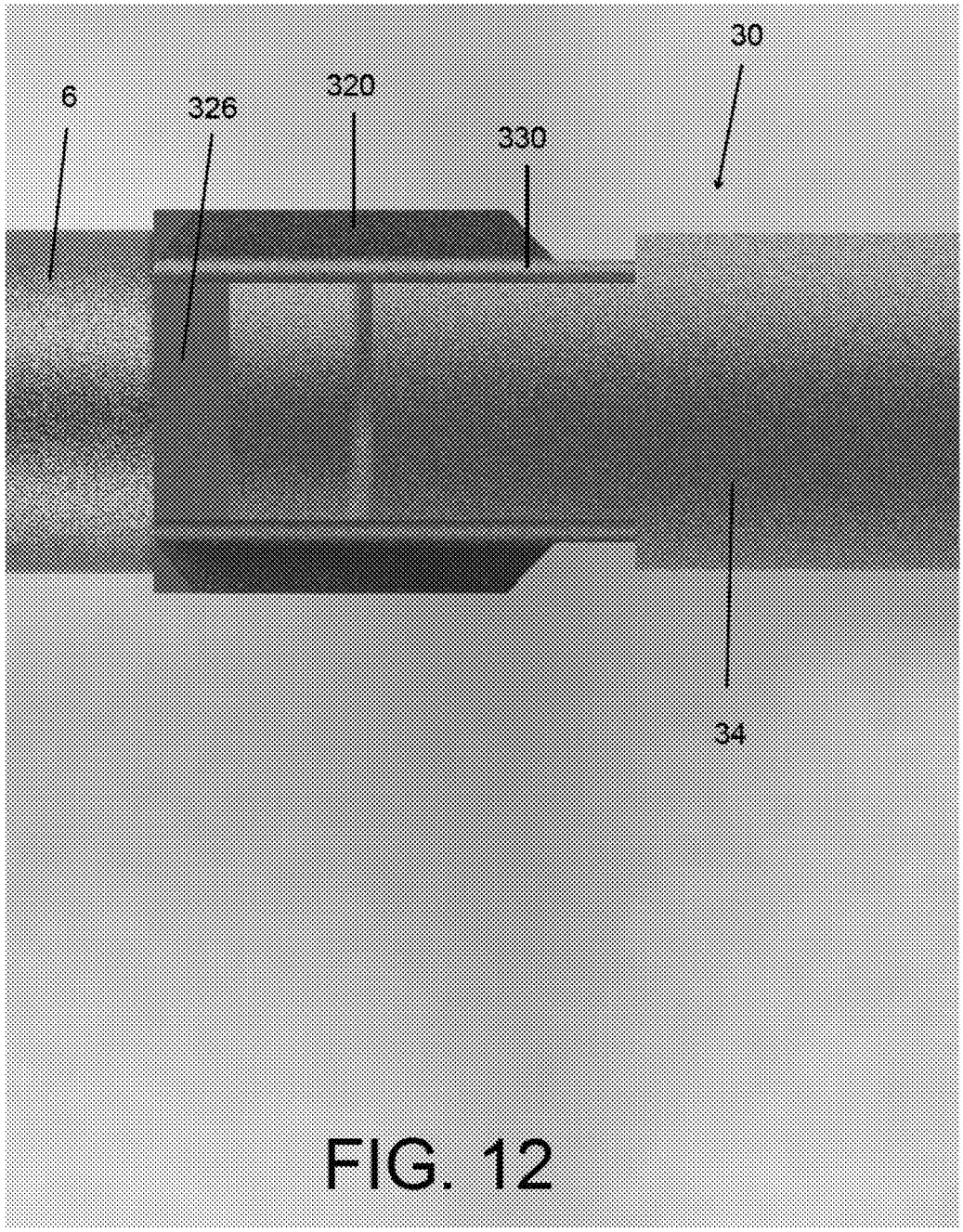
FIG. 12 is a top view of the barrel and intermediate member.
Figure 13:
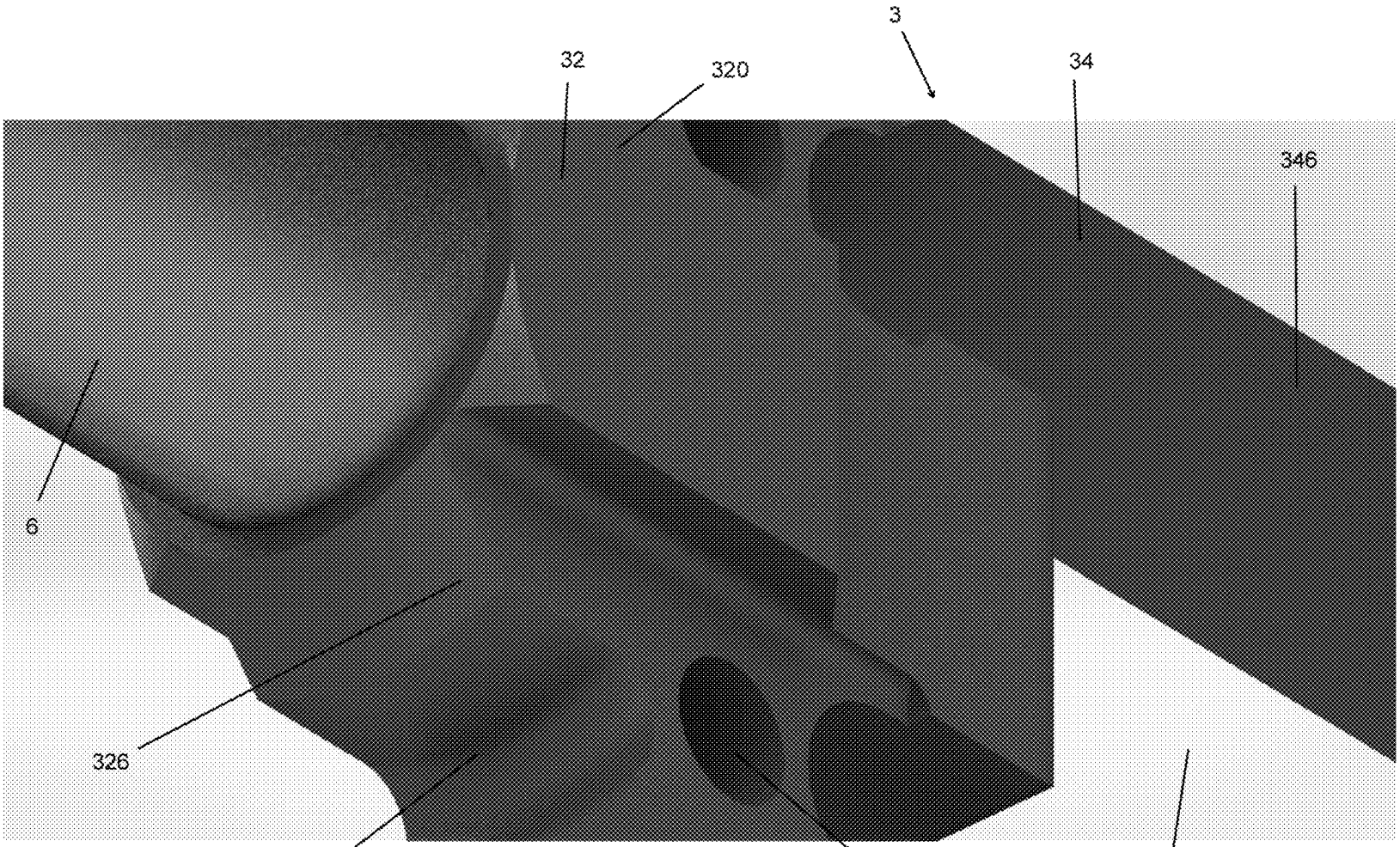
FIG. 13 is a bottom rear perspective view of the intermediate member.

The base member 32 includes an engaging section 320 that is substantially hollow with a threaded portion 322 therein for engagement with a barrel end 3 with substantially matching threads. In other embodiments where the barrel end is provided with dimples or indents instead of threads, the inside of the engaging section could instead be provided with matching indents or protrusions, respectively, for engagement. Outer surfaces 321 of the engaging section 320 are substantially flat so that open ended tools such as wrenches could be utilized to easily engage the engaging section 320 for installation and removal of the intermediate member 30. The engaging section 320 extends away from the barrel end 3 and is positioned between the extension members 34. The engaging section 320 also includes a through hole 324 which is aligned with a central axis of the barrel 2 (or bore 3) so that a round could pass through. The through hole 324 is sized such that the round or bullet does not make contact with the intermediate member 30. Referring to FIG. 11, an inner portion of the base member 32 is also provided with gap 325 for accommodating a washer to provide further security from the intermediate member 30 and barrel extension 6 from disengaging. The washer also provides a seal from carbon debris entering the threaded area. In the alternative, set screws could be utilized to further secure the same. The gap 325 is tightly toleranced so that carbon cannot easily enter, thereby reducing the risk of carbon build up and difficulty in removing the intermediate member 30 from the barrel extension 6.

Figure 14:
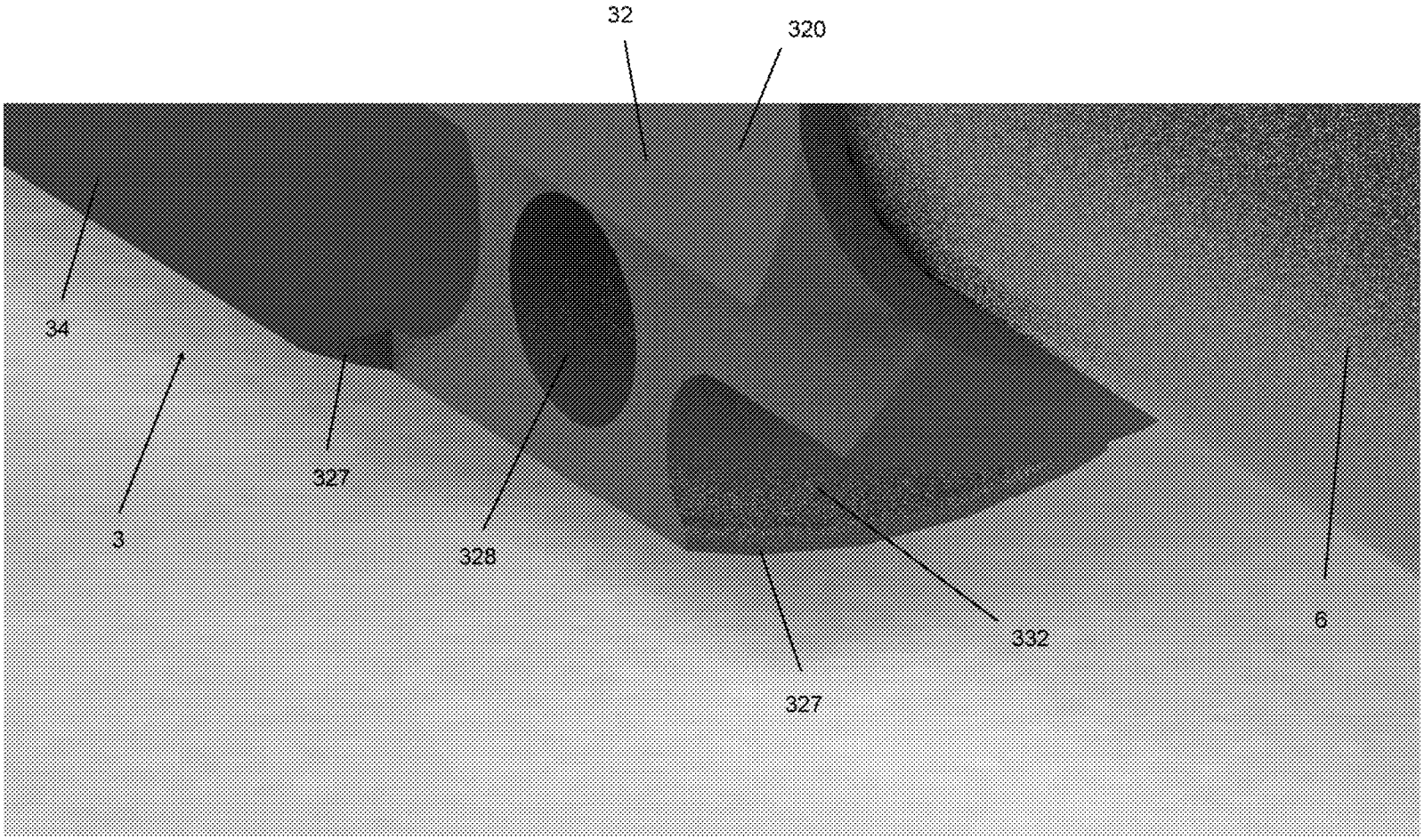
FIG. 14 is top rear perspective view of the intermediate member.
Figure 15:
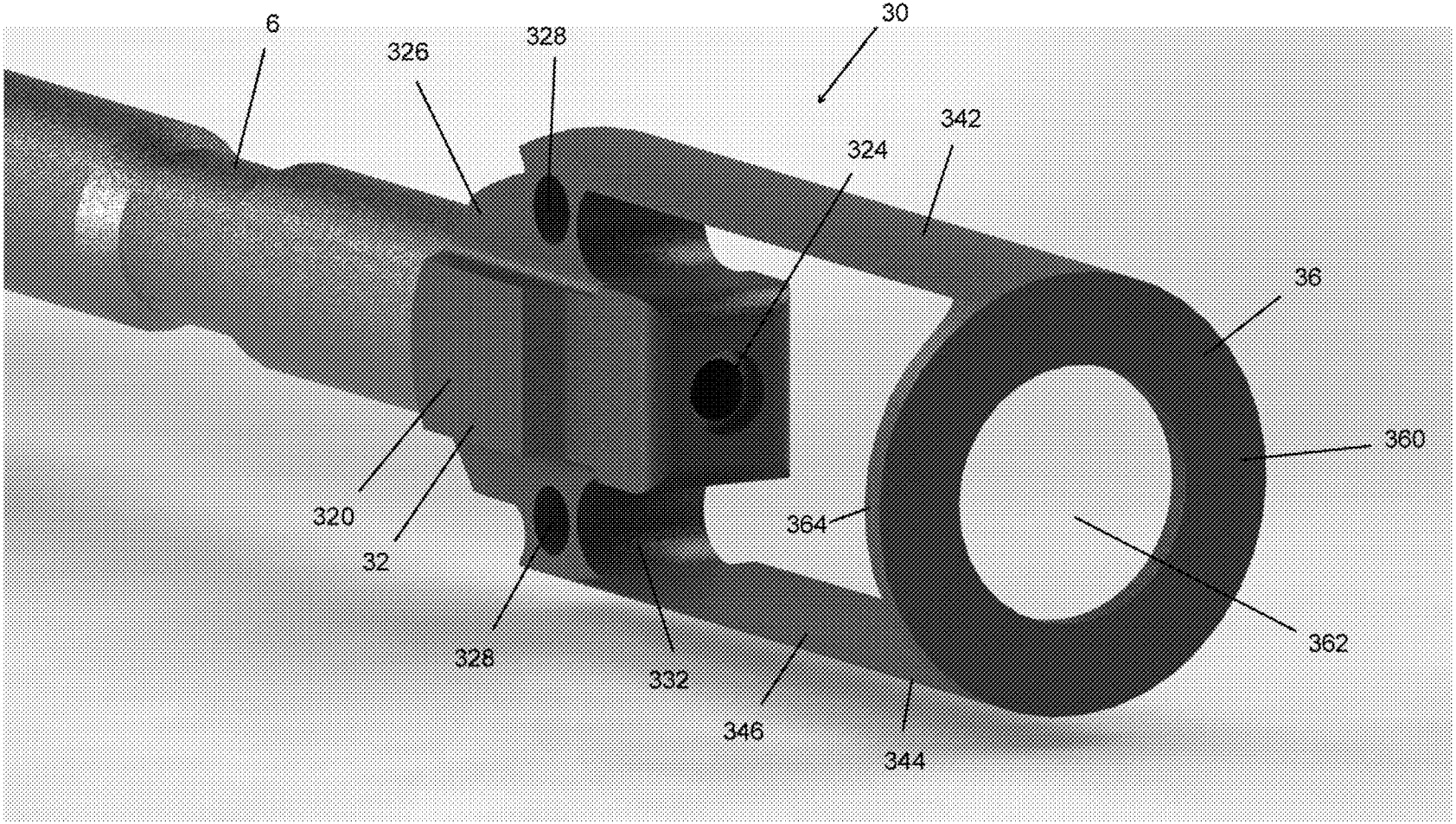
FIG. 15 is front perspective view of the intermediate member and barrel.
Figure 16:
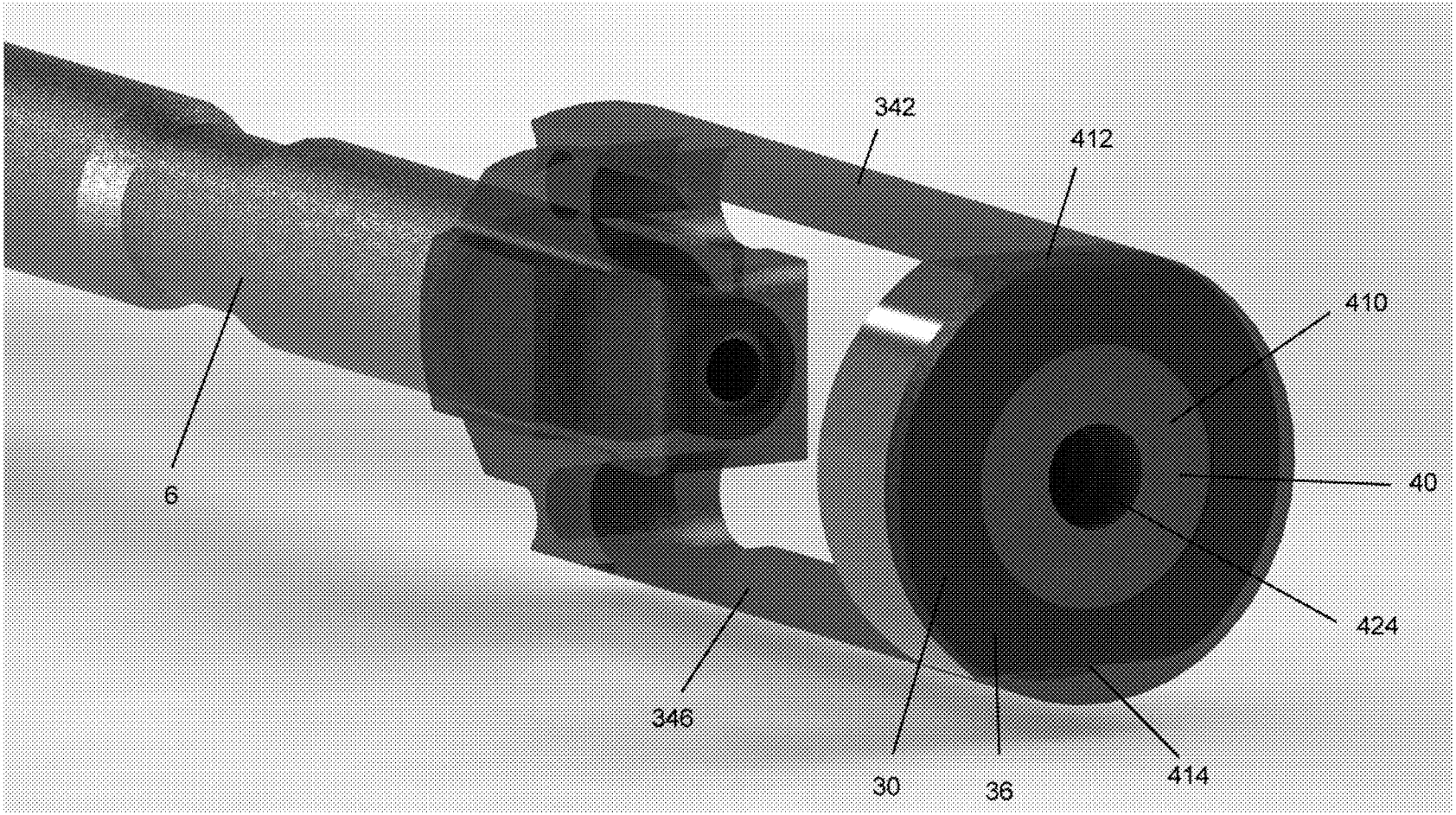
FIG. 16 is a front perspective view of the intermediate member and a blast baffle installed thereon.
Figure 17:
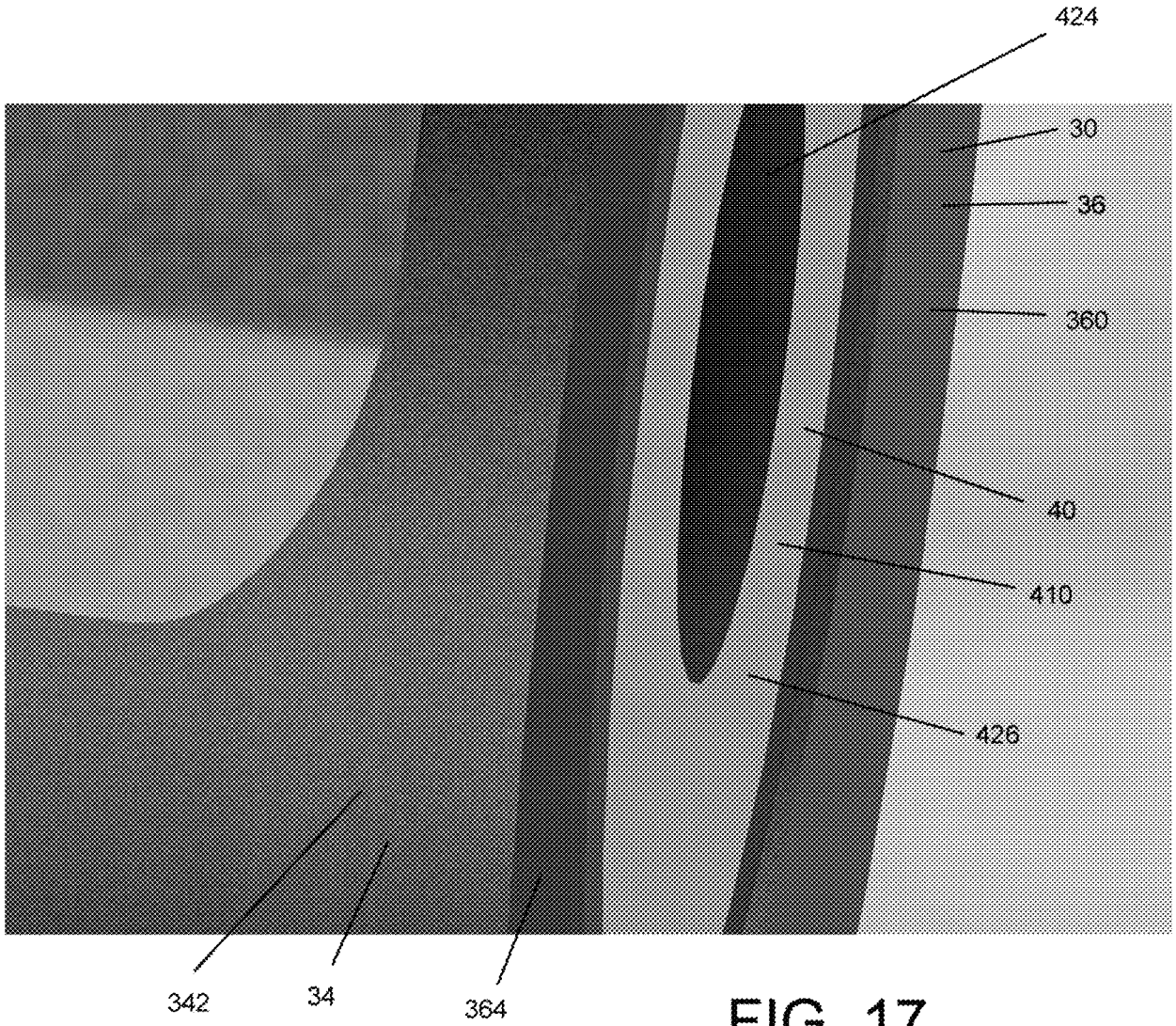
FIG. 17 is a close-up perspective view of FIG. 16.
Figure 18:
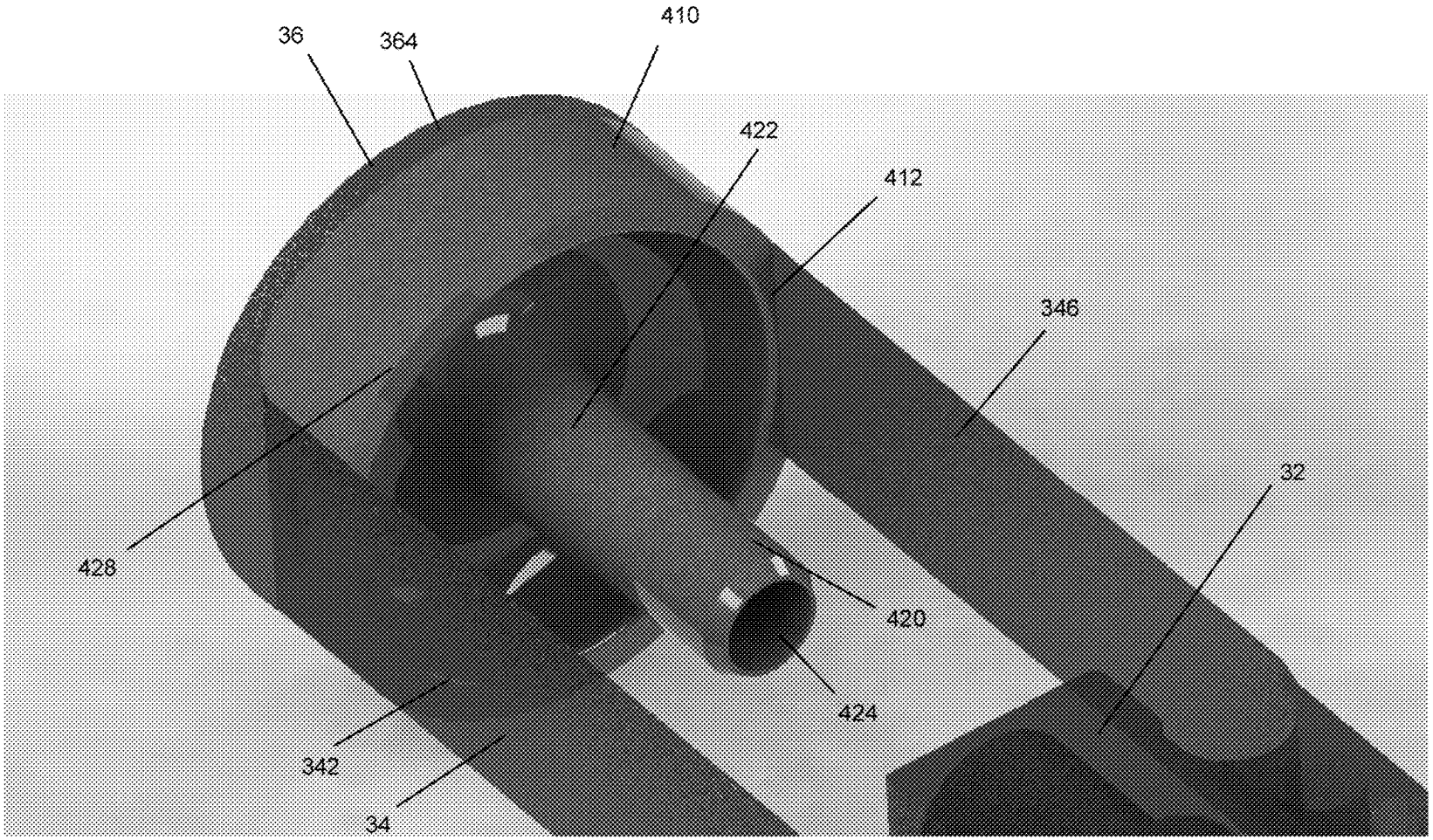
FIG. 18 is a rear side perspective view of FIG. 16.
Figure 19:
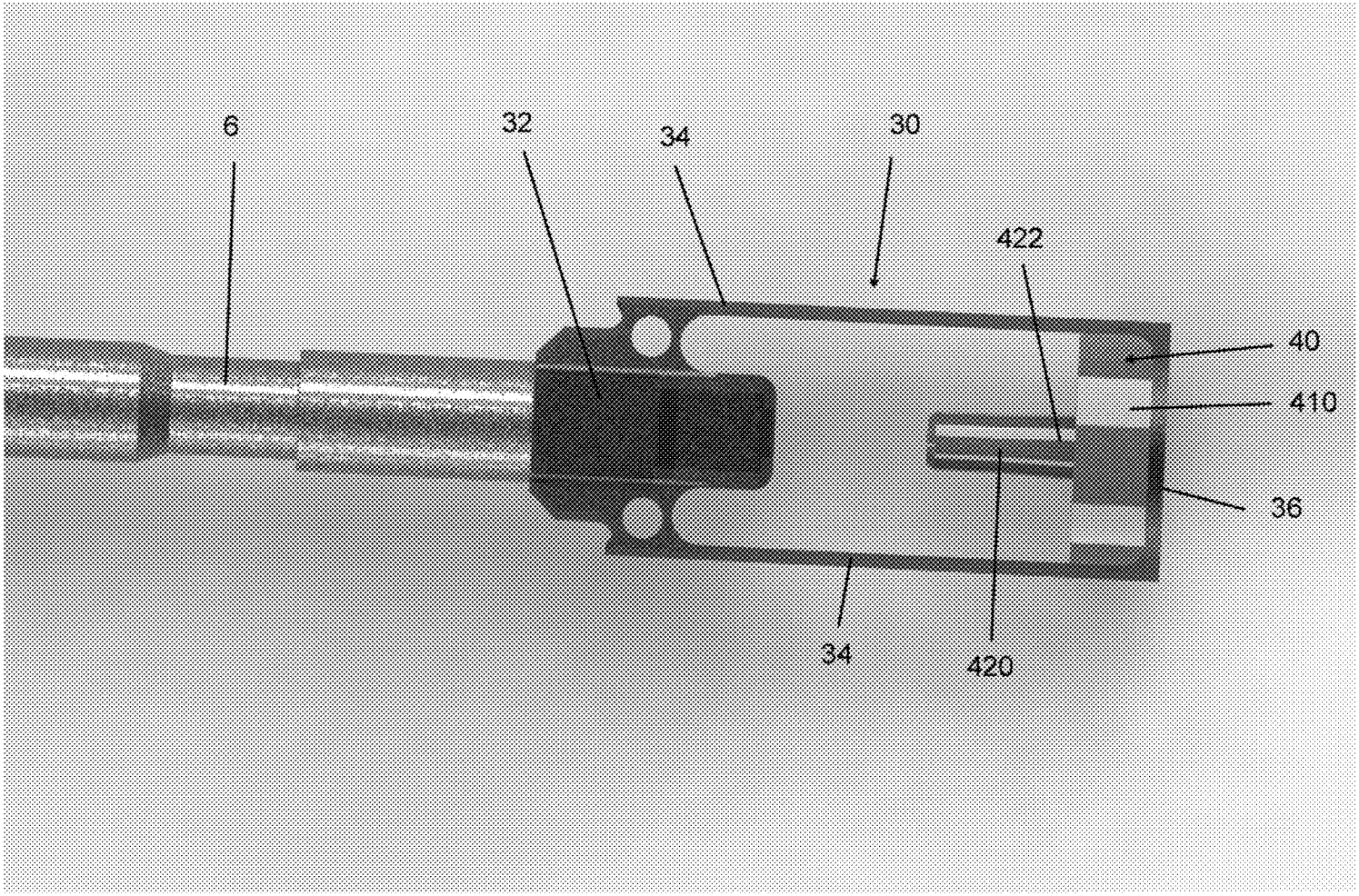
FIG. 19 is a side view of FIG. 16.
Figure 20:
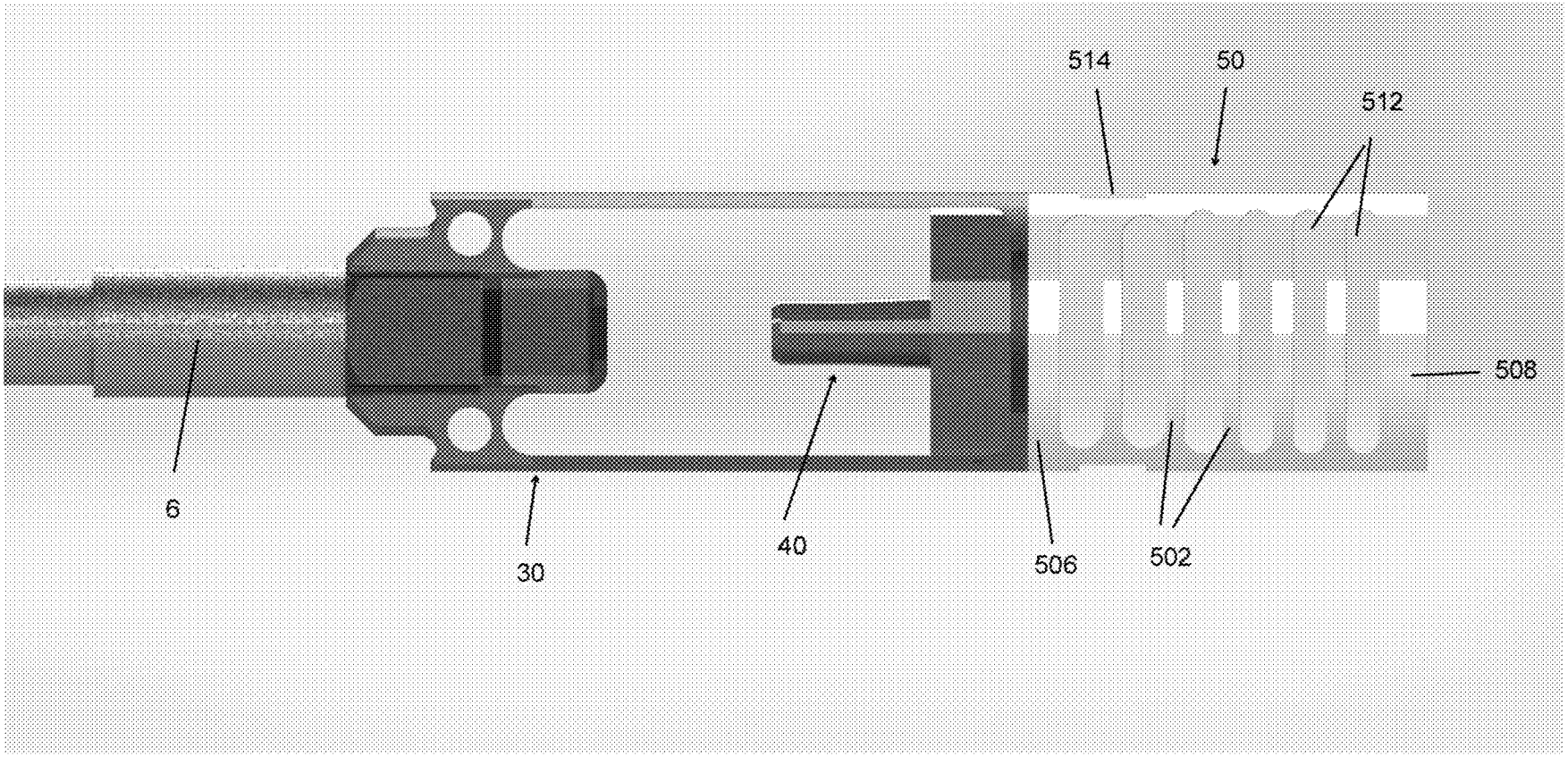
FIG. 20 is a side view of a flash hider installed on the intermediate member and the blast baffle.
Figure 21:
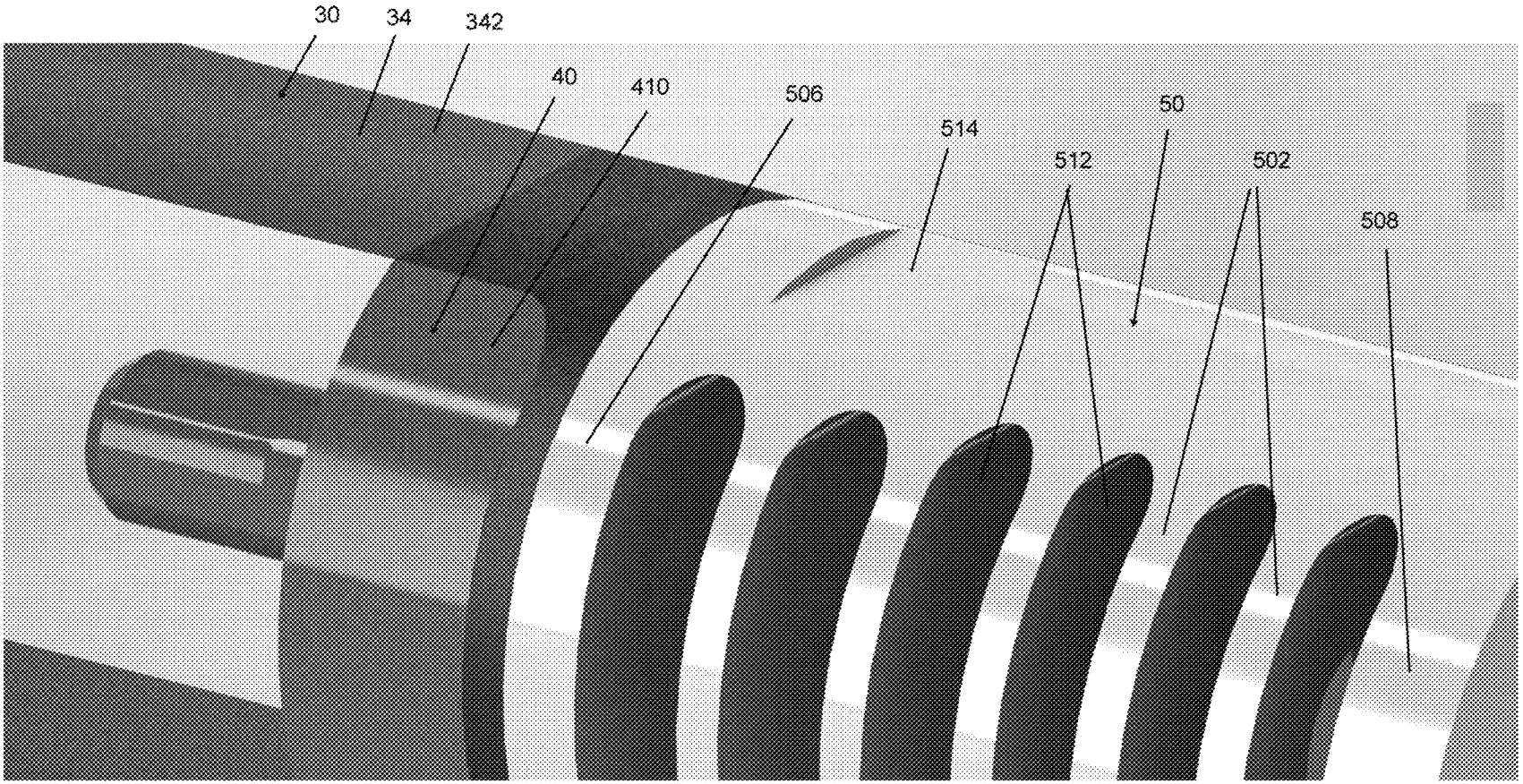
FIG. 21 is a close-up front perspective view of FIG. 20.
Figure 22:
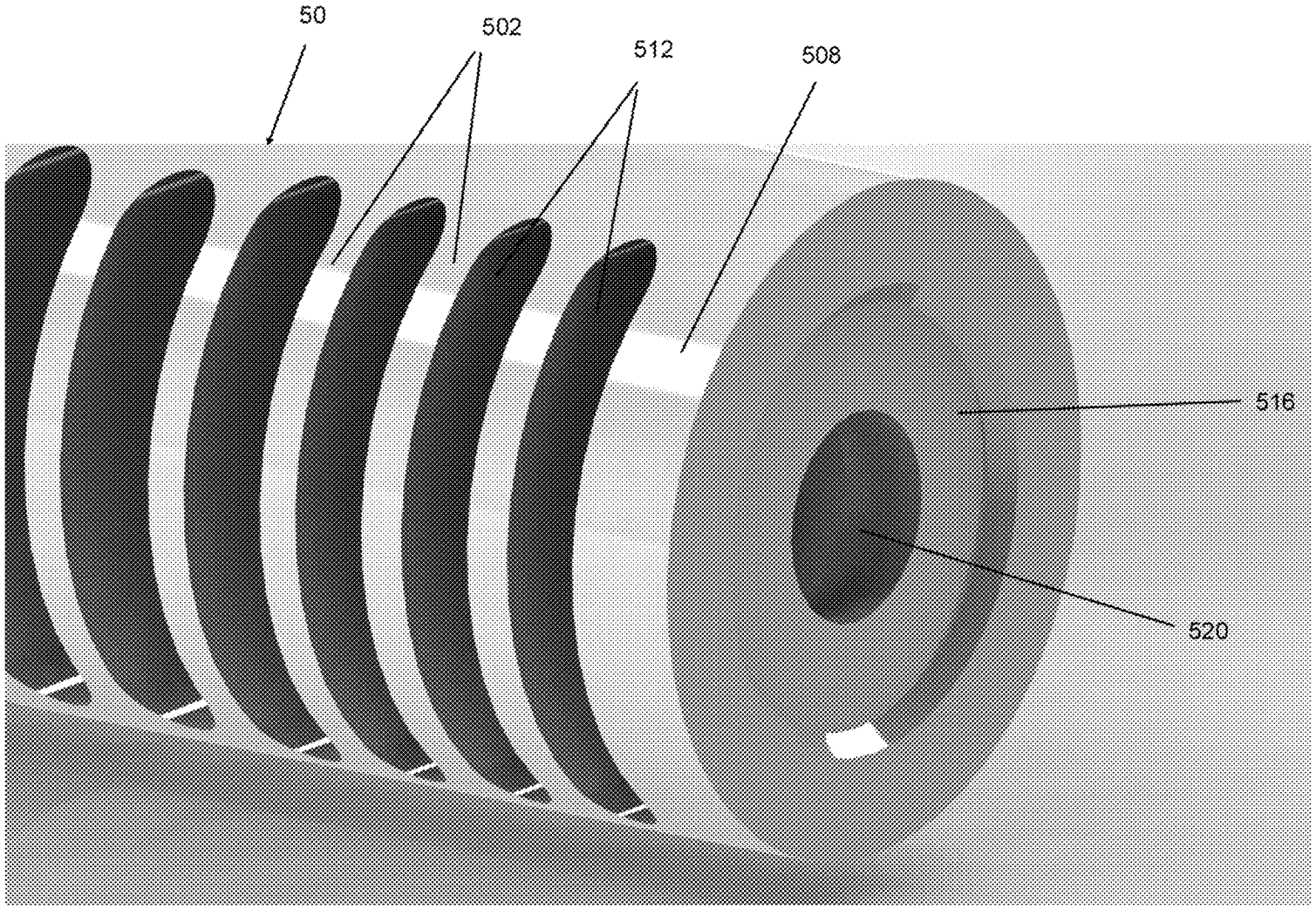
FIG. 22 is a front perspective view of the flash hider.

The base member 32 also includes opposing base extensions 326 extending radially from the engaging section 320. The base extensions 326 include apertures 328 extending therethrough to provide alternative means for removing the intermediate member 30 from the barrel extension 6. That is, in the event a wrench is unavailable, the user could extend other devices through the apertures 328 such as a screw driver to generate sufficient torque for removal. Edges 330 formed between the engaging section 320 and base extensions 326 are rounded or radiused to eliminate high stress areas and to allow for easier cleaning compared with straight ninety degree edges. The rounded edges 330 also provide a less restricted path for gas to travel backward towards the main body 11. In additional the base extensions 326 include rounded or radiused pockets 332 for easily collecting and cleaning accumulated carbon build up or deposits. As shown in FIG. 14, outer edges 327 of the base extensions 326 are sharp so that carbon build up on the inner surface of the tube 10 could be scraped and easily removed when removing the tube 10.

Figure 9:
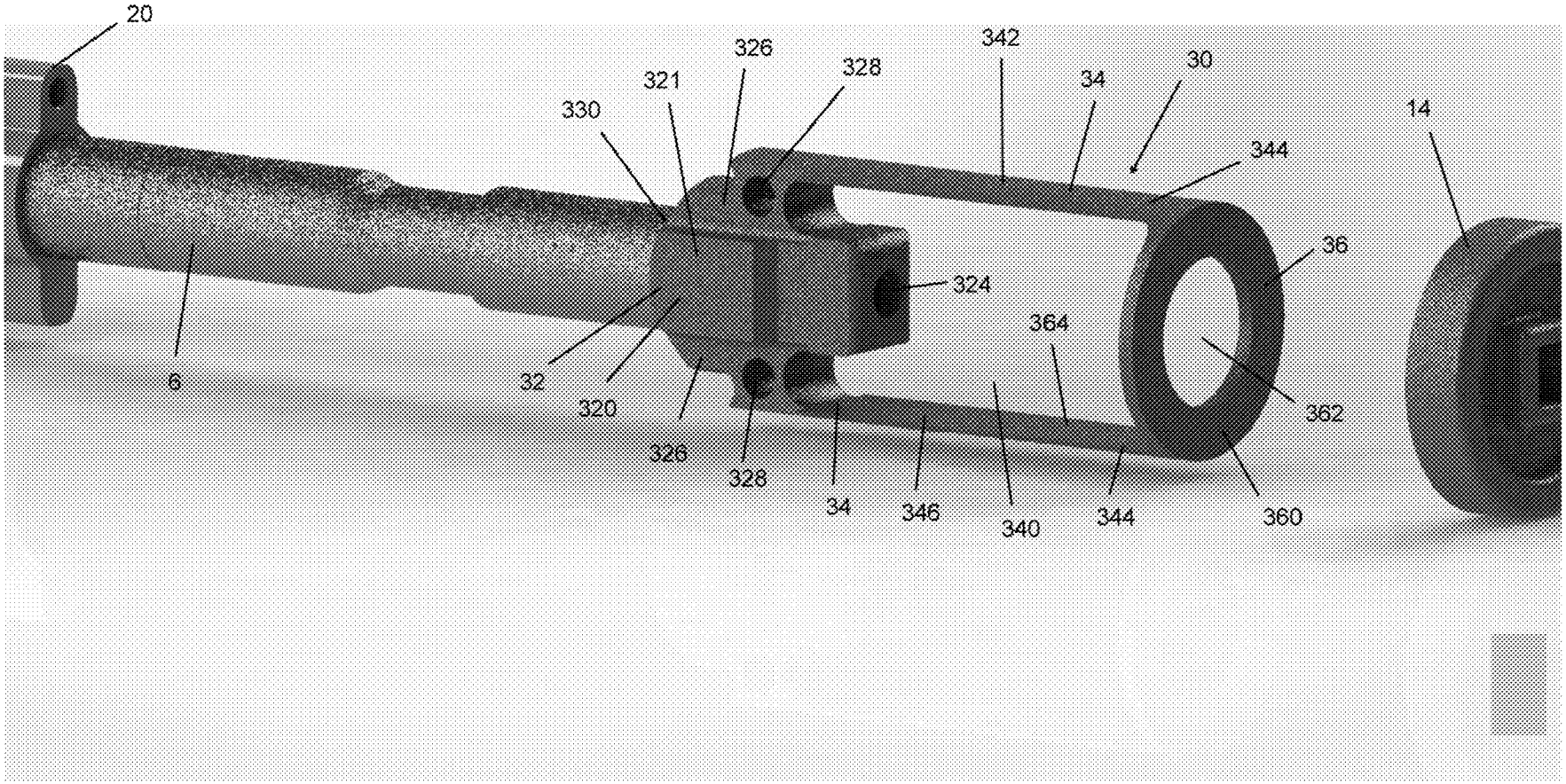
FIG. 9 is a side perspective view of a intermediate member of the suppressor of the present invention.
Figure 10:
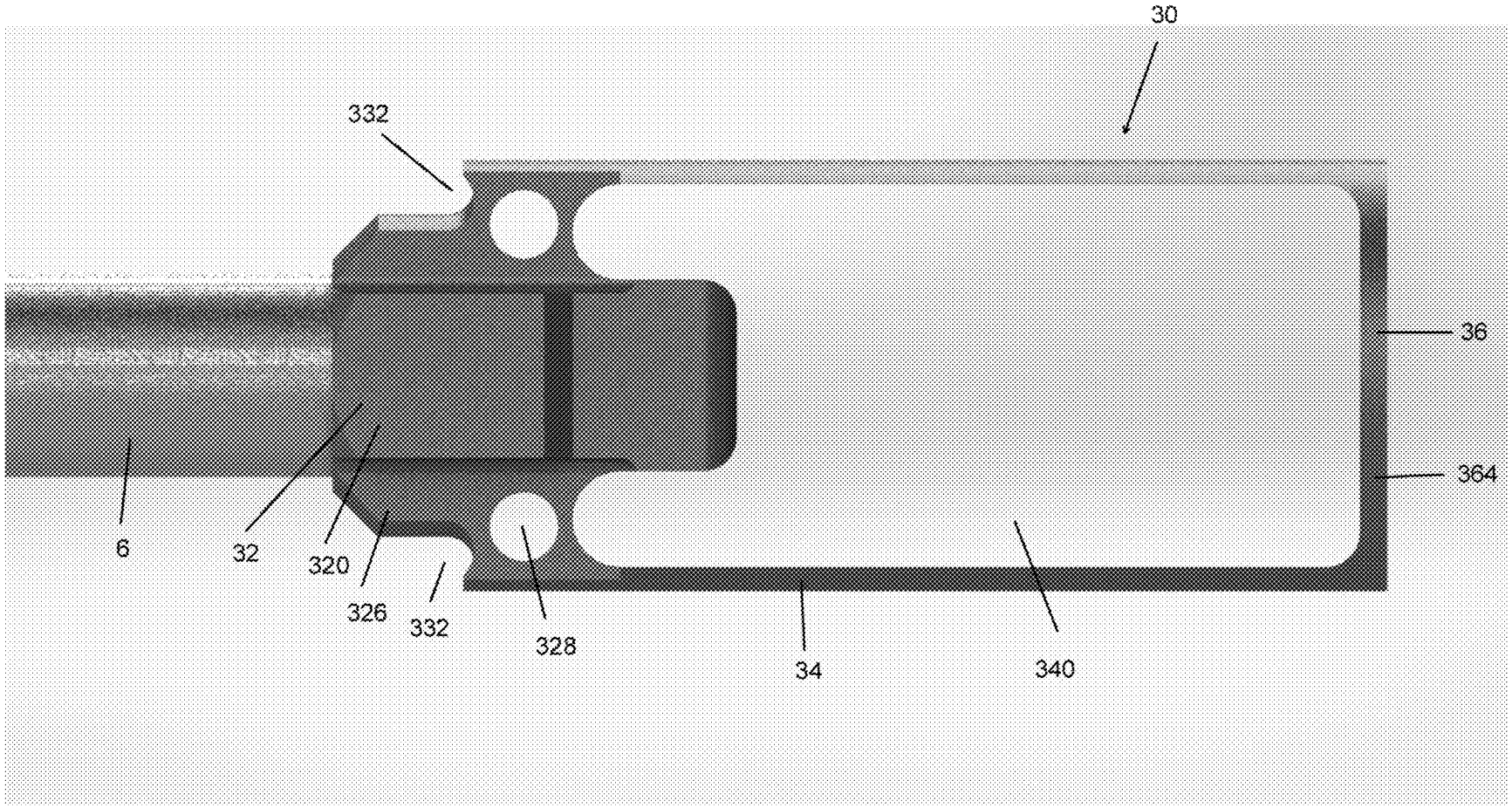
FIG. 10 is a side view of the intermediate member.

As shown in FIG. 9, the extension members 34 extend from the base extensions 326, forming a chamber 340 between the extension members 34. The extension members 34 have rounded outer surfaces 342 (best shown in FIG. 15) which conform with the inner surface of the tube 10 such that the respective surfaces are securely engaged. Inner surfaces 346 are substantially linear and extend through to the ring member 36.

The ring member 36 is integrally formed on the outer ends 344 of the extension members 14. The ring member 36 includes an outer surface 360 and an opposing inner surface (not shown) having an aperture 362 extending therethrough. A side wall 364 extends rearwardly from the ring member inner surface. The inner surface of the ring member 36 includes a linear portion coinciding with the extension member inner surfaces 346.

Referring to FIGS. 16-19, a blast baffle 40 is shown installed on the intermediate member 30. The blast baffle 40 includes an engagement section 410 integrally formed with an extension section 420. The engagement section 410 is substantially cylindrical except that opposing sides 412, 414 are substantially linear to coincide with the extension member inner surfaces 346. As such, the engagement section 410 is configured to snap fit or form fit into the ring member 36. The engagement section 410 includes a free edge 428 which is substantially sharp so that carbon debris could be scraped and removed from the inner surface of the tube 10 when the components are disassembled. The extension section 420 is substantially tubular with at least the outer diameter being greater at a base portion 422. However, the outer diameter of the extension section 420 could be uniform as well. An aperture 424 extends through the engagement section 410 and the extension section 420 at a substantial center and substantially aligned with the bore 3 for a round or projectile to pass through. The size of the aperture 424 is such that the bullet does not make contact with the blast baffle 40. The aperture 424 is threaded on the engagement section 410 as shown in FIG. 23.

Figure 23:
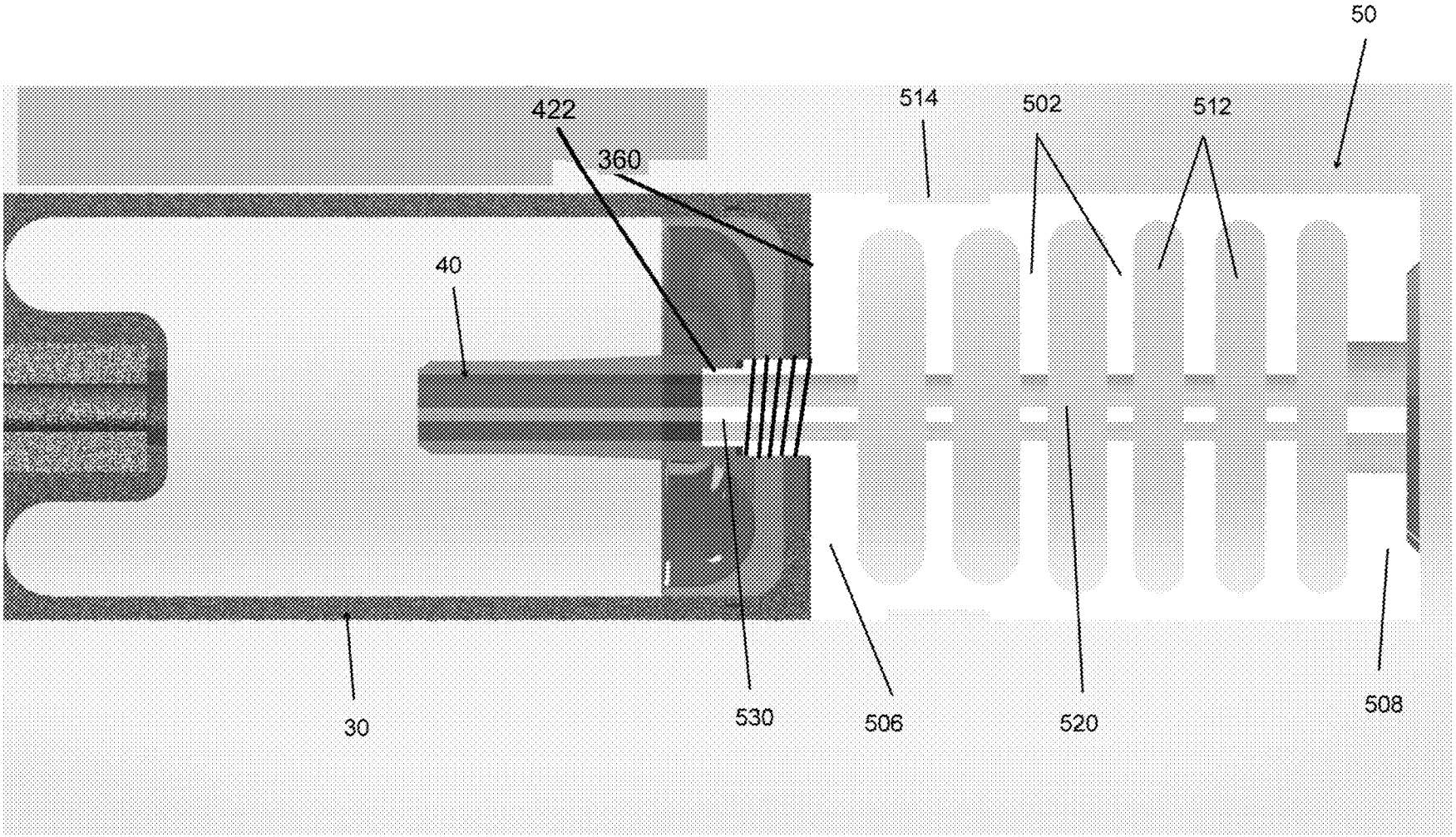
FIG. 23 is a cross-sectional view of FIG. 20.
Figure 24:
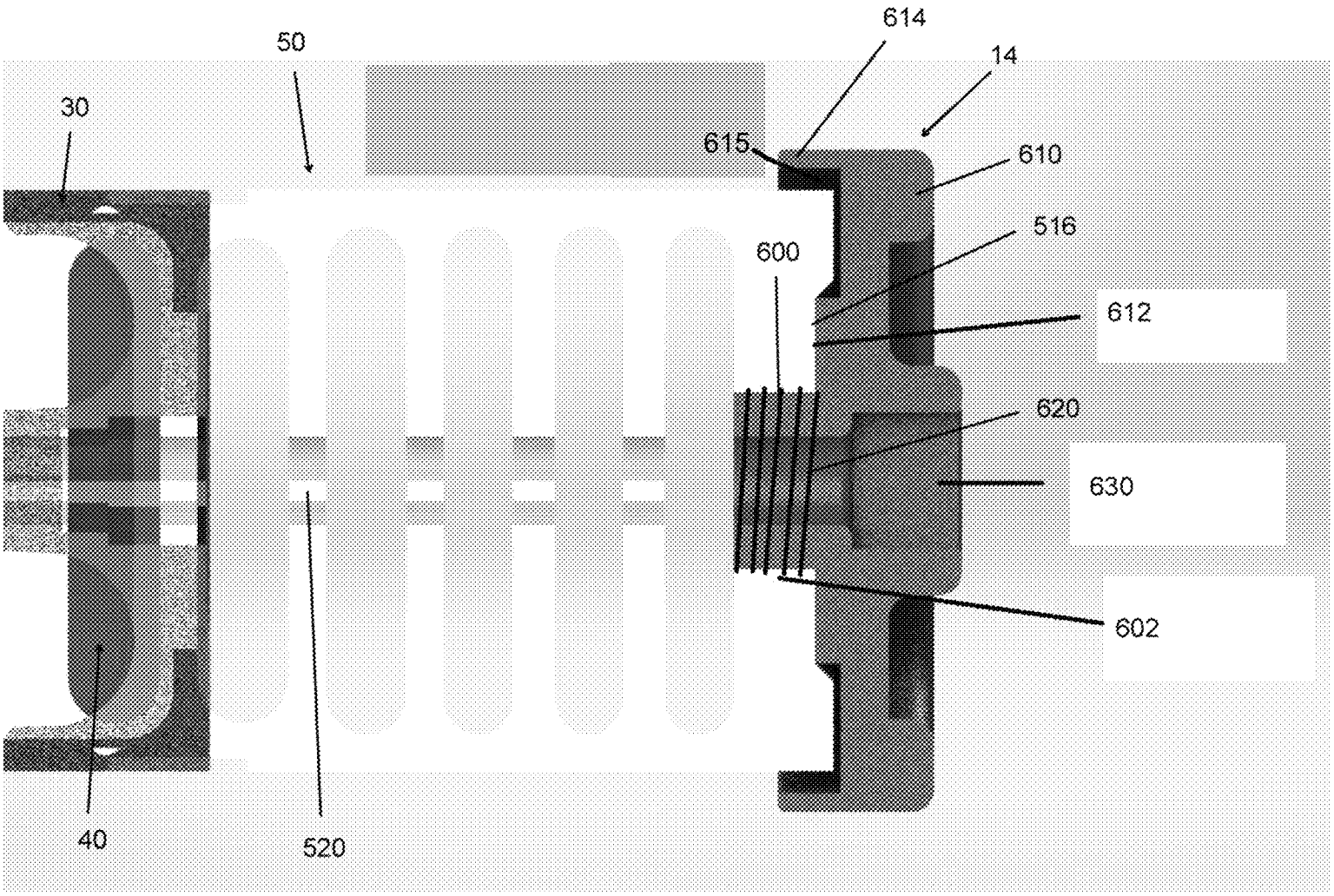
FIG. 24 is a cross-sectional view of a front end cap installed on the flash hider.

Referring to FIGS. 20-26, a flash hider 50 is shown. The general shape of the flash hider 50 is substantially cylindrical and includes a plurality of baffles 502 positioned between an inner end 506 and an outer end 508. The baffles 502 form a plurality of open channels 512 which decrease in width from the inner end 506 to the outer end 508. In this embodiment, five baffles form six channels but this could be varied depending on design requirements. Optionally, a flat surface 514 is provided on opposing outer sides to provide a means from a tool such as a wrench to be used to install and de-install the flash hider 50. In this embodiment, the flat surface 514 extends 1.5 inches but other dimensions could be used as well. An aperture 520 extends through the flash hider 50 at a substantial center and is aligned with the bore 3 for a round or projectile to pass through. The size of the aperture 520 is such that the bullet does not make contact with the flash hider 50. A flash hider extension 530 extends from the inner end 506 at a center position and is threaded for engagement with the threaded portion of the blast baffle 40 as shown in FIG. 23. The positioning and engagement of the threaded blast baffle 40 within the ring member 36 provides the function of a nut for the flash hider 50. Furthermore, with this engagement the flash hider 50 engages the ring member outer surface 360. A space 426 formed between the ring member inner surface and ring member outer surface 360 shown in FIG. 17 (i.e., the thickness of the ring member) adjacent the blast baffle 40 could be provided with a crush washer to further eliminate any open space between the blast baffle 40 and the flash hider 50. The crush washer would further provide a seal from carbon debris from entering the threaded area. Finally, the outer end 508 includes internal threads as shown in FIG. 24.

Figure 26:
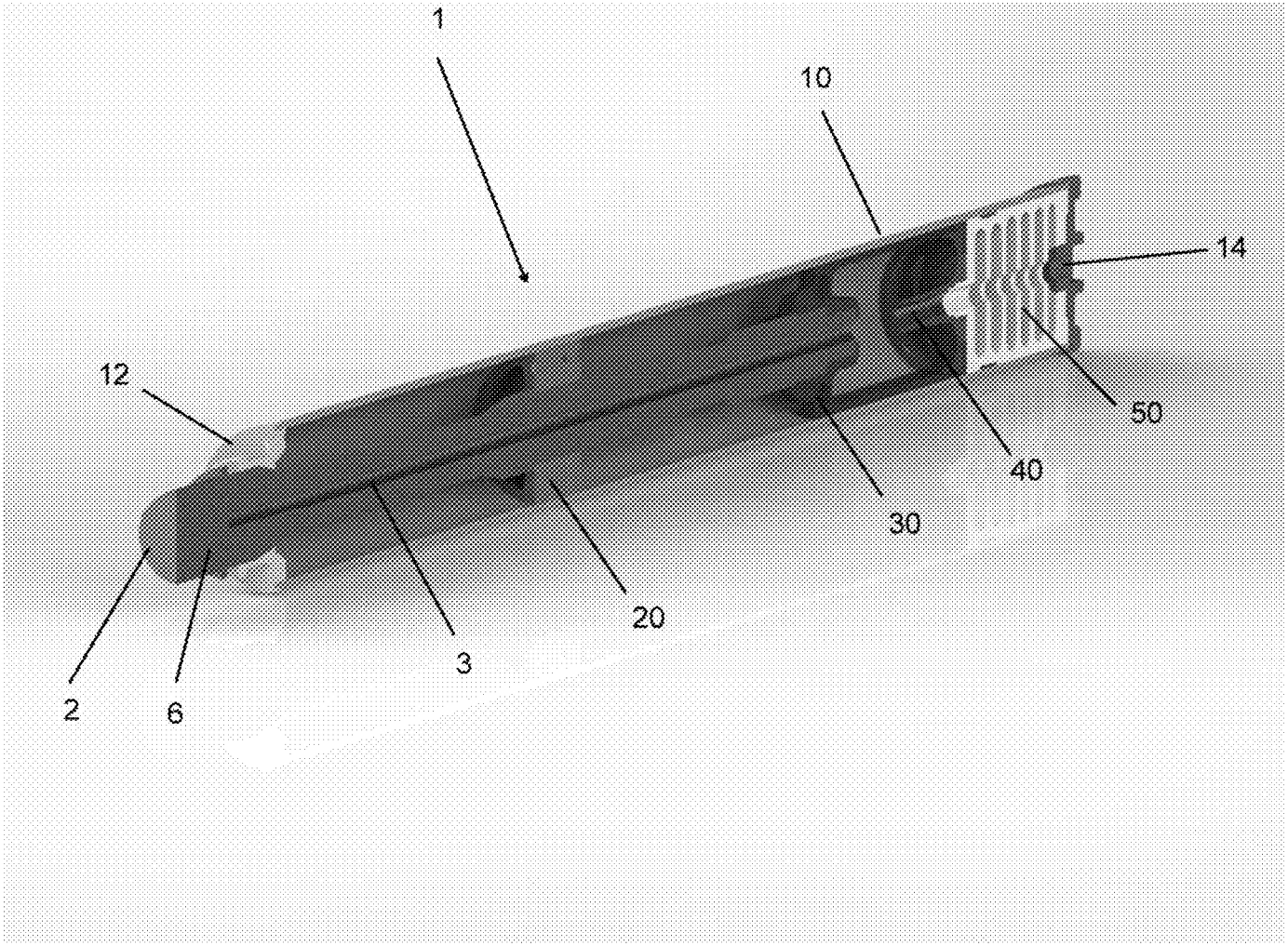
FIG. 26 is a cross-sectional view of the suppressor of the present invention with all components installed on the barrel.

Referring to FIG. 24, the front end cap 14 is shown engaged with the flash hider 50. As with the rear end cap 12, the front end cap 14 is also substantially cylindrical and fixed to the tube 10 in friction or form fit, as shown in FIG. 26. The front end cap 14 includes an extension section 600 integrally formed with a base section 610. The extension section 600 includes a threaded outer surface 602 for engaging with the threaded portion of the flash hider 50. The base section 610 includes an inner surface 612 that engages an outer surface 516 of the flash hider 50. This provides a seal so that carbon debris is prevented from entering the threaded portion. This engagement could also be supplemented with a crush washer to further accomplish the same. The base section 610 also includes a lip portion 614 having an inner diameter that is substantially equal to the outer diameter of the tube 10. As such, a space 615 is provided so the front end cap 14 is secured to the tube 10 to form a substantial seal, as shown in FIG. 26. An aperture 620 extends through the front end cap 14 and is centrally positioned and substantially aligned with the bore 3. The aperture 620 is sized such that a bullet is capable of passing through without making direct contact with the front end cap 14. Moreover, the base section 610 is provided with a drive hole 630 at an outer end for securing the front end cap 14 to the flash hider 50 with a rotational tool. In this embodiment, the drive hole 630 is configured to receive a ⅜ inch hexagonal key but other sizes and shapes could be utilized without departing from the spirit and scope of the invention. As such, the front end cap 14 is secured to the flash hider 50 by threaded engagement and to the tube 10 by form fit.

As shown in FIG. 26, each component is assembled on and around the barrel 2 to form the suppressor 1 of the present invention.

Figure 25:
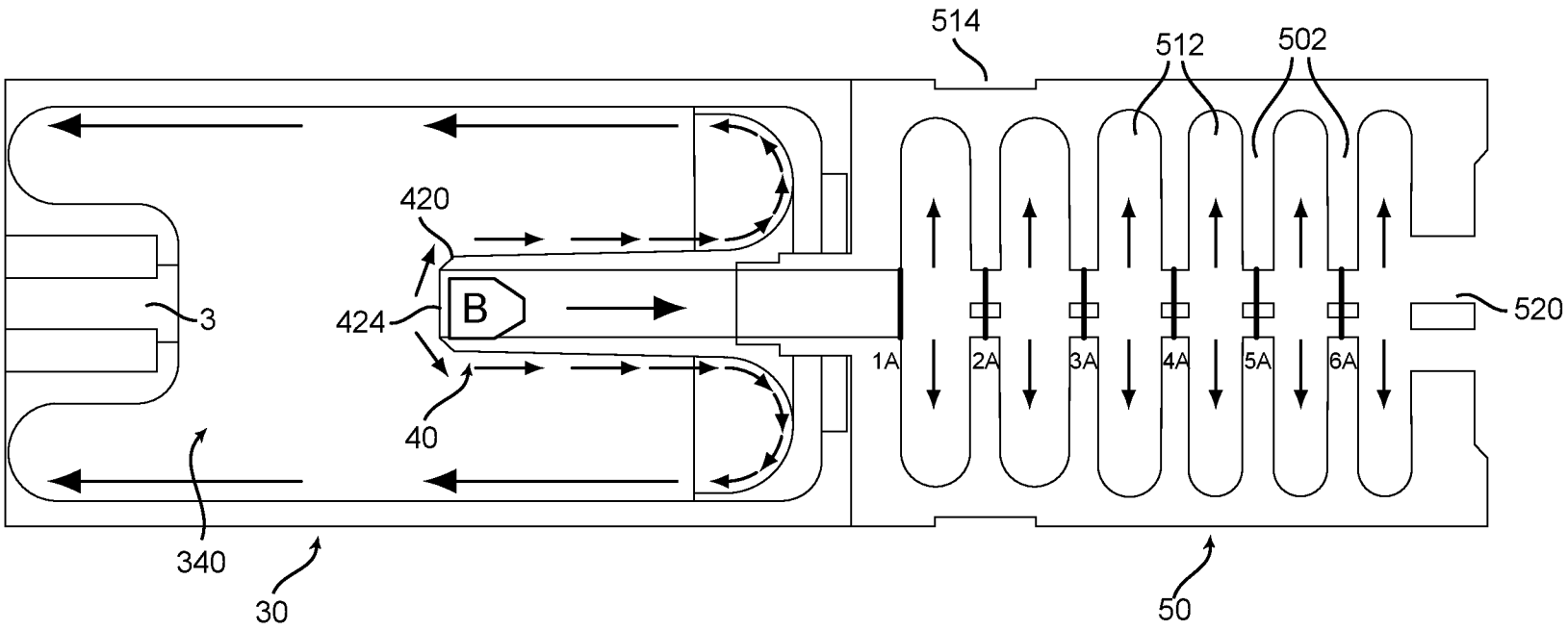
FIG. 25 is a cross-sectional view of the intermediate member and flash hider with an illustration of the movement of gases.

Referring to FIG. 25, in operation, a fired round, bullet or projectile B travels through barrel extension 6 via the bore 3, producing exhaust gas. As the bullet B enters the blast baffle 40, in the intermediate member 30, the blast baffle aperture 424 is partially sealed and gas is dissipated around the extension section 420 of the blast baffle 40 and back toward the rear of the tube 10 to the main body 11 as shown by the arrows in the chamber 340. This is due to the pressure difference within the suppressor 1 in that the intermediate member 30 has a higher pressure than that of the main body 11. Due to the length of the blast baffle extension section 420, sufficient time is provided for sufficient amount of gas to travel backward instead of through the blast baffle 40 and flash hider 50. After the bullet B exits the suppressor 1, in the flash hider 50, the gas is dissipated radially outwardly from the flash hider aperture 520 through the respective channels 512 as shown by the arrows within the channels 512. In addition, excess propellant is burned within each channel 512 as the bullet B travels forward. With the channels 512 being larger toward the rear of the flash hider 50, more propellent is burned earlier during travel. As well, the larger channels 512 toward the rear of the flash hider 50 provide areas of lower pressure than that of the smaller channels in the front so that gas is more susceptible to travel backward. In FIG. 25, each vertical line 1A-6A on the flash hider aperture 520 represents a partial seal that is formed between the bullet B and baffle 512 as the bullet B travels through the flash hider 50. Due to the high pressure in the flash hider 50, gas is further dissipated back towards the main body 11 through the blast baffle 40. As such, exhaust gas is pushed backward to within the tube 10 rather than outward to the ambient air. With this configuration, noise is greatly reduced.

The components of the suppressor 1 are constructed of a high-strength material such as stainless steel, 4140 high tensile steel, B7 alloy steel and titanium. One of ordinary skill in the art will recognize that other materials could be used as well. For example, certain components could be manufactured with high-grade plastics or composite materials with high melting points to reduce weight of the suppressor 1.

The components of the suppressor 1 described above could be installed on an existing barrel of a firearm. As well, the suppressor 1 could be manufactured with a barrel and sold as a combination. Modifications to the barrel and suppressor could be made to customize each combination with different types of firearms for optimal performance including but not limited to customization based on harmonics.

The present invention provides a suppressor which is conveniently and efficiently assembled to and disassembled from a firearm for convenient cleaning and maintenance. Additionally, the present invention provides a suppressor that is exceptionally stable and that protects the internal components from the undesirable characteristics of gunpowder residue buildup and fouling. Moreover, the suppressor of the present invention suppresses noise and flash discharge. As well, the suppressor of the present invention is capable of installing on gas impingement and piston operated firearms by enclosing the gas impingement system, thereby eliminating the need for modification of the firearm while not unduly increasing the overall length of the firearm. Additionally, because of the extra area provided by the suppressor, heat dissipation is also improved.

In the embodiments illustrated in the figures, the suppressor of the present invention can be used on AR-15 rifles as well as any other firearms, whether rifles or handguns and whether automatic, semi-automatic or bolt action. Still other variants that are known now or are developed later are intended to be included within the scope of the term "firearm," as understood by a person of skill in the art.

The present invention may be embodied in other specific forms without departing from its spirit or essential characteristics. The described embodiments are to be considered in all respects only as illustrative and not restrictive. The scope of the invention will be, therefore, indicated by claims rather than by the foregoing description. All changes, which come within the meaning and range of equivalency of the claims, are to be embraced within their scope.

The invention claimed is:

1. A sound suppressor for a firearm comprising:

an enclosure enclosing at least a portion of a barrel of the firearm, the barrel having an inner end and an outer end and extending longitudinally from a receiver of the firearm with the barrel inner end operably coupled to the receiver of the firearm, a space between the enclosure and barrel forming a main body;

an intermediate member having an inner end and an outer end, the intermediate member inner end operably coupled to an outer end of the barrel, the intermediate member comprising:

a base member positioned proximate the intermediate member inner end, the base member having a first through-hole extending longitudinally therethough, a ring member having an inner surface and an opposing outer surface, the ring member positioned proximate the intermediate member outer end, and a plurality of extension members, each extension member having an inner and an opposing outer end, and an inner surface and an opposing outer surface, the plurality of extension members extending between the base member and the ring member, a space between the plurality of extension members forming a chamber;

a flash hider having an inner end and an outer end, the flash hider inner end operably coupled to the intermediate member outer end, the flash hider comprising:

a plurality of baffles extending radially and spaced apart longitudinally from the flash hider inner end to the flash hider outer end, and a plurality of open channels formed between the plurality of baffles, each open channel having a longitudinal width;

wherein the intermediate member and flash hider are enclosed within the enclosure; and wherein the longitudinal width of each of the plurality of open channels of the flash hider decreases from the flash hider inner end to flash hider outer end.

2. The sound suppressor of claim 1, wherein the intermediate member further comprises a blast baffle comprising an inner end and an outer end, the blast baffle operably coupled to the ring member inner surface and inner surfaces of the plurality of extension members proximate the intermediate member outer end.

3. The sound suppressor of claim 2, wherein the blast baffle further comprises:

an engagement section configured to engage with the ring member and the plurality of extension members; and an extension section having an inner surface and an outer surface, the extension section extending longitudinally from the engagement section toward the base member;

wherein the engagement section and extension section include a second through-hole substantially aligned with the first through-hole.

4. The sound suppressor of claim 3, wherein the second through-hole increases in diameter from the blast baffle inner end to the blast baffle outer end.

5. The sound suppressor of claim 3, wherein the outer surfaces of the plurality of extension members are substantially engaged with the enclosure.

6. The sound suppressor of claim 1, wherein the intermediate member inner end and barrel outer end are coupled together by threaded engagement.

7. A sound suppressor for a firearm comprising:

an enclosure enclosing at least a portion of a barrel of the firearm, the barrel having an inner end and an outer end and extending longitudinally from a receiver of the firearm with the barrel inner end operably coupled to the receiver of the firearm, a space between the enclosure and barrel forming a main body;

an intermediate member having an inner end and an outer end, the intermediate member inner end operably coupled to an outer end of the barrel, the intermediate member comprising:

a base member positioned proximate the intermediate member inner end, the base member having a first through-hole extending longitudinally therethough, a ring member having an inner surface and an opposing outer surface, the ring member positioned proximate the intermediate member outer end, and a plurality of extension members, each extension member having an inner and an opposing outer end, and an inner surface and an opposing outer surface, the plurality of extension members extending between the base member and the ring member, a space between the plurality of extension members forming a chamber;

a flash hider having an inner end and an outer end, the flash hider inner end operably coupled to the intermediate member outer end, the flash hider comprising:

a plurality of baffles extending radially and spaced apart longitudinally from the flash hider inner end to the flash hider outer end, and a plurality of open channels formed between the plurality of baffles, each open channel having a longitudinal width;

wherein the intermediate member and flash hider are enclosed within the enclosure; and wherein the flash hider inner end and the intermediate member outer end are coupled together by threaded engagement.

8. The sound suppressor of claim 7, wherein the intermediate member inner end and barrel outer end are coupled together by threaded engagement.

9. A sound suppressor for a firearm comprising:

an enclosure enclosing at least a portion of a barrel of the firearm, the barrel having an inner end and an outer end and extending longitudinally from a receiver of the firearm with the barrel inner end operably coupled to the receiver of the firearm;

an intermediate member having an inner end and an outer end, the intermediate member inner end operably coupled to an outer end of the barrel;

a flash hider having an inner end and an outer end, the flash hider inner end operably coupled to the intermediate member outer end;

wherein the intermediate member and flash hider are enclosed within the enclosure; and a gas block having an inner section and an outer section, wherein the gas block is configured to hold a gas tube extending from the receiver of the firearm, wherein the gas block inner section is operably coupled with the barrel between the barrel inner end and the intermediate member, and wherein the gas block outer section is substantially engaged with the enclosure and enclosed therein.

10. The sound suppressor of claim 9, wherein the gas block further comprises:

a first aperture operably coupled with an intermediate barrel aperture and a gas tube aperture;

wherein the gas block is configured to transfer gases from the barrel to the gas tube.

11. The sound suppressor of claim 10, wherein the gas block further comprises a second aperture operably coupled with the gas tube, the second aperture configured to transfer excess gas from the gas tube to the main body.

12. The sound suppressor of claim 9, wherein the intermediate member inner end and barrel outer end are coupled together by threaded engagement.

13. The sound suppressor of claim 9, wherein the intermediate member comprises:

a base member positioned proximate the intermediate member inner end, the base member having a first through-hole extending longitudinally therethough;

a ring member having an inner surface and an opposing outer surface, the ring member positioned proximate the intermediate member outer end;

a plurality of extension members, each extension member having an inner and an opposing outer end, and an inner surface and an opposing outer surface, the plurality of extension members extending between the base member and the ring member, a space between the plurality of extension members forming a chamber; and a blast baffle having an inner end and an outer end, the blast baffle operably coupled to the ring member inner surface and inner surfaces of the plurality of extension members proximate the intermediate member outer end.

14. The sound suppressor of claim 13, wherein the blast baffle comprises:

an engagement section configured to engage with the ring member and the plurality of extension members; and an extension section having an inner surface and an outer surface, the extension section extending longitudinally from the engagement section toward the base member;

wherein the engagement section and extension section include a second through-hole substantially aligned with the first through-hole.

15. The sound suppressor of claim 14, wherein the second through-hole increases in diameter from the blast baffle inner end to the blast baffle outer end.

16. The sound suppressor of claim 13, wherein the outer surfaces of the plurality of extension members are substantially engaged with the enclosure.

17. The sound suppressor of claim 9, wherein the flash hider comprises:

a plurality of baffles extending radially and spaced apart longitudinally from the flash hider inner end to the flash hider outer end;

a plurality of open channels formed between the plurality of baffles, each open channel having a longitudinal width;

wherein the longitudinal width of each of the plurality of open channels decreases from the flash hider inner end to flash hider outer end.

18. A sound suppressor for a firearm comprising:

an enclosure enclosing at least a portion of a barrel of the firearm, the barrel having an inner end and an outer end and extending longitudinally from a receiver of the firearm with the barrel inner end operably coupled to the receiver of the firearm;

an intermediate member having an inner end and an outer end, the intermediate member inner end operably coupled to an outer end of the barrel;

a flash hider having an inner end and an outer end, the flash hider inner end operably coupled to the intermediate member outer end;

wherein the intermediate member and flash hider are enclosed within the enclosure; and wherein the flash hider inner end and the intermediate member outer end are coupled together by threaded engagement.

19. The sound suppressor of claim 18, wherein the intermediate member inner end and barrel outer end are coupled together by threaded engagement.

* * * * *